US007979945B2

(12) United States Patent
Dayton et al.

(10) Patent No.: US 7,979,945 B2
(45) Date of Patent: Jul. 19, 2011

(54) SYSTEMS AND METHODS FOR ROBOTIC GUTTER CLEANING

(75) Inventors: Douglas C. Dayton, Harvard, MA (US); Sung Park, Waban, MA (US)

(73) Assignee: Umagination Labs, L.P., Newton, MA (US)

( * ) Notice: Subject to any disclaimer, the term of this patent is extended or adjusted under 35 U.S.C. 154(b) by 0 days.

(21) Appl. No.: 11/834,908

(22) Filed: Aug. 7, 2007

(65) Prior Publication Data

US 2008/0098553 A1 May 1, 2008

Related U.S. Application Data

(60) Provisional application No. 60/838,100, filed on Aug. 15, 2006.

(51) Int. Cl.
*B08B 1/04* (2006.01)
*B08B 9/36* (2006.01)
*B08B 9/38* (2006.01)

(52) U.S. Cl. ..... 15/104.15; 15/23; 15/88.4; 15/104.9

(58) Field of Classification Search ..... 134/8, 22.1; 15/3, 4, 21.1, 88.4, 104.5, 104.09, 23, 104.15
See application file for complete search history.

(56) References Cited

U.S. PATENT DOCUMENTS 1,875,529 A 9/1932 Vandervoort
2,539,003 A 1/1951 Agustoni
3,751,749 A 8/1973 Wilson
3,800,358 A * 4/1974 Ryan ..... 15/312.1
3,952,239 A 4/1976 Owings et al.
3,973,179 A 8/1976 Weber et al.
4,050,003 A 9/1977 Owings et al.
4,121,320 A 10/1978 Feiner
4,168,559 A * 9/1979 Henson ..... 15/23
4,202,068 A 5/1980 Lester et al.
4,204,292 A 5/1980 Lester et al.
4,238,866 A 12/1980 Taylor
4,757,786 A 7/1988 Ellegard
4,810,855 A 3/1989 Dassi et al.
4,815,158 A * 3/1989 Crotts ..... 15/53.2
4,958,397 A * 9/1990 Ryan ..... 15/93.1
4,989,323 A 2/1991 Casper et al.
5,149,230 A 9/1992 Nett
5,265,341 A 11/1993 Kikuchi et al.
5,311,641 A * 5/1994 Matsuura et al. ..... 15/406

(Continued)

FOREIGN PATENT DOCUMENTS

WO WO-9857006 A1 12/1998

(Continued)

OTHER PUBLICATIONS

"U.S. Appl. No. 11/838,697, Final Office Action mailed Aug. 5, 2010", , 11.

(Continued)

*Primary Examiner* — Michael Barr
*Assistant Examiner* — Saeed T Chaudhry
(74) *Attorney, Agent, or Firm* — Strategic Patents, P.C.

(57) ABSTRACT

In embodiments of the present invention, a gutter-cleaning device comprises a housing containing an impeller drive facility, the housing configured to fit into a gutter, an impeller, disposed at an end of the housing and driven by the impeller drive facility, and a transport facility for transporting the housing along the gutter.

12 Claims, 18 Drawing Sheets

1100

U.S. PATENT DOCUMENTS 5,379,846 A 1/1995 Wagster et al.
5,416,944 A * 5/1995 Eriksson ..... 15/104.09
5,544,417 A 8/1996 Atos et al.
5,577,286 A 11/1996 Smith et al.
5,615,970 A 4/1997 Reekie et al.
5,692,417 A 12/1997 Irpino
5,709,136 A 1/1998 Frenkel
5,718,014 A 2/1998 deBlois et al.
5,802,724 A 9/1998 Rickard et al.
5,809,653 A 9/1998 Everts et al.
5,834,623 A 11/1998 Ignagni
5,855,067 A 1/1999 Taomo et al.
5,926,961 A 7/1999 Uhl
6,089,331 A 7/2000 Christ
6,153,838 A 11/2000 Wadge
6,170,579 B1 1/2001 Wadge
6,176,322 B1 1/2001 Wadge
6,181,032 B1 1/2001 Marshall et al.
6,185,782 B1 2/2001 Hall
6,206,107 B1 3/2001 Wadge
6,237,177 B1 * 5/2001 Richardson ..... 15/4
6,263,979 B1 7/2001 Dyke et al.
6,263,980 B1 7/2001 Wadge
6,264,211 B1 7/2001 Granado
D447,035 S 8/2001 Netzler
D447,037 S 8/2001 Netzler
D447,038 S 8/2001 Netzler
6,286,611 B1 9/2001 Bone
6,301,788 B1 10/2001 Webster
6,352,127 B1 3/2002 Yorde
6,374,447 B1 4/2002 Armbruster et al.
6,459,955 B1 10/2002 Bartsch et al.
6,463,824 B1 10/2002 Prell et al.
6,488,511 B1 12/2002 Stewart
6,553,642 B2 4/2003 Driessen
6,564,823 B1 5/2003 Mankins
6,634,439 B2 10/2003 Driessen
6,640,667 B1 11/2003 Pomerantz et al.
6,641,439 B2 11/2003 Kim
6,651,347 B2 11/2003 Uhl
6,755,597 B2 6/2004 Bergner et al.
6,832,531 B1 12/2004 Marquardt
6,851,254 B1 2/2005 Dalfors
6,923,094 B1 8/2005 Marquardt
7,014,546 B1 3/2006 Birk
7,021,399 B2 4/2006 Driessen
7,114,824 B2 10/2006 Picone
7,121,598 B2 10/2006 Pourtier et al.
7,152,328 B2 12/2006 Champlin
7,234,743 B2 6/2007 Robinson
7,255,024 B2 8/2007 Johnson et al.
7,334,503 B1 2/2008 Newman
7,354,408 B2 4/2008 Muchisky
7,363,673 B2 4/2008 Schonewille et al.
7,484,300 B2 2/2009 King et al.
7,886,399 B2 2/2011 Dayton et al.
7,926,141 B2 4/2011 Dayton et al.
2004/0003503 A1 1/2004 McDonald
2004/0074025 A1 4/2004 Blaustein et al.
2005/0111214 A1 5/2005 Zeiler
2005/0243553 A1 11/2005 Picone
2007/0000138 A1 1/2007 Baskar et al.
2007/0050991 A1 3/2007 Mooney et al.
2007/0240892 A1 10/2007 Brotto et al.
2008/0092311 A1 4/2008 Munn et al.
2008/0104780 A1 5/2008 Dayton et al.
2008/0155769 A1 7/2008 Schonewille et al.
2008/0173138 A1 7/2008 Dayton et al.
2008/0189870 A1 8/2008 Dayton et al.
2008/0216869 A1 9/2008 Dayton et al.
2008/0250570 A1 10/2008 Dayton et al.

FOREIGN PATENT DOCUMENTS

WO WO-2005089020 A1 9/2005
WO WO-2008/021848 A3 2/2008
WO WO-2008021848 A2 2/2008
WO WO-2008022167 A2 2/2008
WO WO-2008022167 A3 2/2008

OTHER PUBLICATIONS

"U.S. Appl. No. 11/838,697, Notice of Allowance mailed Dec. 14, 2010", , 7.
"U.S. Appl. No. 12/027,968, Notice of Allowance mailed Dec. 22, 2010", , 15.
"U.S. Appl. No. 11/838,697 Non-Final Office Action mailed Jan. 27, 2010", , 17.
"U.S. Appl. No. 11/935,296 Non-Final Office Action mailed Sep. 19, 2008", OARN , 10 Pgs.
"U.S. Appl. No. 12/027,204, Non-Final Office Action mailed Sep. 1, 2009", , 8.
"U.S. Appl. No. 12/027,204, Non-Final Office Action mailed Dec. 23, 2008", , 11 pgs.
"U.S. Appl. No. 12/027,968, Non-Final Office Action mailed Jun. 2, 2010", , 15 pgs.
"The Stihl Kombisystem and Yard Boss Website", http://www.stihlusa.com/multitask/.
ISA, , "International Search Report and Written Opinion", For US Patent Application No. PCT/US07/75954, mailed on Apr. 11, 2008.

* cited by examiner

1100

SYSTEMS AND METHODS FOR ROBOTIC GUTTER CLEANING

CROSS-REFERENCE TO RELATED APPLICATIONS

This application claims the benefit of the following provisional application, which is hereby incorporated by reference in its entirety: U.S. provisional patent application Ser. No. 60/838,100, filed Aug. 15, 2006.

BACKGROUND

1. Field

The present invention generally relates to systems and methods for robotic gutter cleaning.

2. Description of the Related Art

Cleaning debris from a gutter may be difficult and dangerous, especially when an individual uses a ladder to reach the gutter and leans laterally to reach portions of the gutter for cleaning.

SUMMARY

Provided herein may be methods and systems for gutter cleaning and a gutter-cleaning device thereof. In an aspect of the invention, a gutter-cleaning device includes a housing containing an impeller drive facility, the housing configured to fit into a gutter; an impeller, disposed at an end of the housing and driven by the impeller drive facility; and a transport facility for transporting the housing along the gutter. In the device, the impeller may be removably connected. In the device, the impeller drive facility may include a transmission. In the device, the impeller may be a rotating impeller. In the device, the impeller may be configured to remove debris from a gutter. In the device, the housing may include an energy storage facility. In the device, the device may further include a placement facility for facilitating placement of the gutter-cleaning device into a gutter. A placement pole, optionally telescoping, may attach to a placement facility to facilitate placing the gutter-cleaning device in the gutter. The placement facility may be spring-loaded to keep the placement facility vertical unless a lateral force is applied to the placement facility. In the device, the device may further include a control facility. The control facility may include an antenna. The antenna may be integrated with a placement facility. The control facility may be a remote control facility. The remote control facility may include a wireless communication facility. In the device, the transport facility may include a rotational transport facility. In the device, the device may further include an impeller chute for housing a portion of the impeller, wherein debris may be rotated against the chute by the impeller prior to ejection from the gutter. In the device, the device may further include debris tines disposed at one or both ends of the gutter-cleaning device to loosen and lift matted debris from the bottom and sides of the gutter into the impeller. The debris tines may be formed from at least one of metal, wood, plastic, and molded elastomer. The debris tines may be coated with a solid debris removal solvent. The impeller may be formed from at least one of a molded elastomer, neoprene, rubber, plastic, and an electrostatic cloth. The impeller may be at least one of a helical-bristled brush, a flexible paddle, a full stiff bristle brush, a spiral stiff bristle brush, a wire brush, a dethatching brush, an alternating paddle brush, a flexible bucket, a multiply-vaned impeller, and an alternating flexible blade. In the device, the transport facility may be at least one of a wheel, a snake drive, a worm drive, a crab or walking drive, a scoot-and-compress or accordion drive, and a string of beads drive. The wheel may be at least one of a tractor/tread wheel and tractor treads/tracks, finned hemispherical wheels, rubber wheels, vulcanized wheels, plastic wheels, molded elastomer wheels, and metal wheels. The wheel may be connected through an axle to a drive shaft. In the device, the device may further include a vision system disposed on the housing for facilitating navigation and programming of the device. The vision system may include a solid state camera, a camera lens, and a video signal electronics module. In the device, the device may further include a moisture sensor for detecting prohibitive levels of moisture in a gutter. In the device, the transport facility and the impeller drive facility may each control both transport and impellers. In the device, the device may further include at least one of an on-board tool or attachment, a downspout cleaning tool, an air hose attachment, a water hose attachment, a vacuum facility, and a weed whacker attachment. The vacuum facility may provide a vacuum through at least one of the impellers, the impeller vane attachment point, the housing, and a vacuum hose attachment. In the device, the impeller drive facility may be at least one of a reversing gear motor, an electric motor, a gasoline- or biofuel-powered internal combustion engine, and a solar-powered motor. In the device, the transport facility may be at least one of a reversing gear motor, an electric motor, a gasoline- or biofuel-powered internal combustion engine, and a solar-powered motor. In the device, the housing may be formed from at least one of metal, plastic, molded elastomer, weather-resistant materials, water-resistant materials, solvent-resistant materials, temperature-resistant materials, shock-resistant materials, and breakage-resistant materials. In the device, the device may further include a navigation system to facilitate autonomous control of the device. The navigation system may be integrated with at least one of a proximity sensor, a vision system, a programming facility, and a moisture sensor. In the device, the device may further include an energy storage facility connected to the transport and impeller drives for providing power. The energy storage facility may be at least one of a battery, a gasoline fuel or biofuel tank, and a solar panel. The battery may be at least one of rechargeable, disposable, lead-acid, gel, nickel cadmium, nickel metal hydride, lithium ion, zinc carbon, zinc chloride, alkaline, silver oxide, lithium ion disulphide, lithium thionyl chloride, mercury, zinc air, thermal, water activated, and nickel oxyhydroxide. In the device, the device may further include a programming facility to set programs for autonomous control. Programming may be done by at least one of wirelessly and a direct connection to a programming interface.

In an aspect of the invention, a gutter cleaning system includes a gutter-cleaning device, further including: a housing, the housing configured to fit into a gutter; and an impeller, disposed at an end of the housing and driven by an impeller drive facility; and a placement pole, optionally telescoping, operably connected to the gutter-cleaning device, further including: an impeller drive facility electrically connected to an impeller; optionally, a transport facility for transporting the housing along the gutter; and an energy storage facility electrically connected to the impeller drive facility and the transport facility for providing power. In the device, the impeller may be removably connected. In the device, the impeller drive facility may include a transmission. In the device, the impeller may be a rotating impeller. In the device, the impeller may be configured to remove debris from a gutter. In the device, the housing may include an energy storage facility. In the device, the device may further include a control facility. The control facility may include an antenna.

The control facility may be a remote control facility. The remote control facility may include a wireless communication facility. In the device, the transport facility may include a rotational transport facility. In the device, the device may further include an impeller chute for housing a portion of the impeller, wherein debris may be rotated against the chute by the impeller prior to ejection from the gutter. In the device, the device may further include debris tines disposed at one or both ends of the gutter-cleaning device to loosen and lift matted debris from the bottom and sides of the gutter into the impeller. The debris tines may be formed from at least one of metal, wood, plastic, and molded elastomer. The debris tines may be coated with a solid debris removal solvent. The impeller may be formed from at least one of a molded elastomer, neoprene, rubber, plastic, and an electrostatic cloth. The impeller may be at least one of a helical-bristled brush, a flexible paddle, a full stiff bristle brush, a spiral stiff bristle brush, a wire brush, a dethatching brush, an alternating paddle brush, a flexible bucket, a multiply-vaned impeller, and an alternating flexible blade. In the device, the transport facility and the impeller drive facility may each control both transport and impellers. In the device, the device may further include at least one of an on-board tool or attachment, a downspout cleaning tool, an air hose attachment, a water hose attachment, a vacuum facility, and a weed whacker attachment. The vacuum facility may provide a vacuum through at least one of the impellers, the impeller vane attachment point, the housing, and a vacuum hose attachment. In the device, the impeller drive facility may be at least one of a reversing gear motor, an electric motor, a gasoline- or biofuel-powered internal combustion engine, and a solar-powered motor. In the device, the transport facility may be at least one of a reversing gear motor, an electric motor, a gasoline- or biofuel-powered internal combustion engine, and a solar-powered motor. In the device, the housing may be formed from at least one of metal, plastic, molded elastomer, weather-resistant materials, water-resistant materials, solvent-resistant materials, temperature-resistant materials, shock-resistant materials, and breakage-resistant materials. In the device, the device may further include a navigation system to facilitate autonomous control of the device. The navigation system may be integrated with at least one of a proximity sensor, a vision system, a programming facility, and a moisture sensor. In the device, the device may further include an energy storage facility connected to the transport and impeller drives for providing power. The energy storage facility may be at least one of a battery, a gasoline fuel or biofuel tank, and a solar panel. The battery may be at least one of rechargeable, disposable, lead-acid, gel, nickel cadmium, nickel metal hydride, lithium ion, zinc carbon, zinc chloride, alkaline, silver oxide, lithium ion disulphide, lithium thionyl chloride, mercury, zinc air, thermal, water activated, and nickel oxyhydroxide. In the device, the device may further include a programming facility to set programs for autonomous control. Programming may be done by at least one of wirelessly and a direct connection to a programming interface. In the device, the placement pole may be removably associated with the gutter-cleaning device.

In an aspect of the invention, a method of a gutter-cleaning device may include providing a housing containing an impeller drive facility, the housing configured to fit into a gutter; disposing an impeller at an end of the housing and driving the impeller with the impeller drive facility; and providing a transport facility for transporting the housing along the gutter. In the method, the impeller may be removably connected. In the method, the impeller drive facility may include a transmission. In the method, the impeller may be a rotating impeller. In the method, the impeller may be configured to remove debris from a gutter. In the method, the housing may include an energy storage facility. The method may further include providing a placement facility for facilitating placement of the gutter-cleaning device into a gutter. A placement pole, optionally telescoping, may attach to a placement facility to facilitate placing the gutter-cleaning device in the gutter. The placement facility may be spring-loaded to keep the placement facility vertical unless a lateral force is applied to the placement facility. The method may further include providing a control facility. The control facility may comprise an antenna. The antenna may be integrated with a placement facility. The control facility is a remote control facility. The remote control facility may include a wireless communication facility. In the method, the transport facility may include a rotational transport facility. The method may further include housing a portion of the impeller in an impeller chute, wherein debris may be rotated against the chute by the impeller prior to ejection from the gutter. The method may further include disposing debris tines at one or both ends of the gutter-cleaning device to loosen and lift matted debris from the bottom and sides of the gutter into the impeller. The debris tines may be formed from at least one of metal, wood, plastic, and molded elastomer. The debris tines may be coated with a solid debris removal solvent. In the method, the impeller may be formed from at least one of a molded elastomer, neoprene, rubber, plastic, and an electrostatic cloth. In the method, the impeller may be at least one of a helical-bristled brush, a flexible paddle, a full stiff bristle brush, a spiral stiff bristle brush, a wire brush, a dethatching brush, an alternating paddle brush, a flexible bucket, a multiply-vaned impeller, and an alternating flexible blade. In the method, the transport facility may be at least one of a wheel, a snake drive, a worm drive, a crab or walking drive, a scoot-and-compress or accordion drive, and a string of beads drive. The wheel may be at least one of a tractor/tread wheel and tractor treads/tracks, finned hemispherical wheels, rubber wheels, vulcanized wheels, plastic wheels, molded elastomer wheels, and metal wheels. The wheel may be connected through an axle to a drive shaft. The method may further include disposing a vision system disposed on the housing for facilitating navigation and programming of the device. The vision system may include a solid state camera, a camera lens, and a video signal electronics module. The method may further include providing a moisture sensor for detecting prohibitive levels of moisture in a gutter. In the method, the transport facility and the impeller drive facility may each control both transport and impellers. The method may further include providing at least one of an on-board tool or attachment, a downspout cleaning tool, an air hose attachment, a water hose attachment, a vacuum facility, and a weed whacker attachment. In the method, the vacuum facility may provide a vacuum through at least one of the impellers, the impeller vane attachment point, the housing, and a vacuum hose attachment. In the method, the impeller drive facility may be at least one of a reversing gear motor, an electric motor, a gasoline- or biofuel-powered internal combustion engine, and a solar-powered motor. In the method, the transport facility may be at least one of a reversing gear motor, an electric motor, a gasoline- or biofuel-powered internal combustion engine, and a solar-powered motor. In the method, the housing may be formed from at least one of metal, plastic, molded elastomer, weather-resistant materials, water-resistant materials, solvent-resistant materials, temperature-resistant materials, shock-resistant materials, and breakage-resistant materials. The method may further include providing a navigation system to facilitate autonomous control of the device. The navigation system may be integrated with at least one of a proximity sensor, a vision system, a programming facility, and a moisture sensor. The method may further include connecting an energy storage facility to the transport and impeller drives for providing power. The energy storage facility may be at least one of a battery, a gasoline fuel or biofuel tank, and a solar panel. The battery may be at least one of rechargeable, disposable, lead-acid, gel, nickel cadmium, nickel metal hydride, lithium ion, zinc carbon, zinc chloride, alkaline, silver oxide, lithium ion disulphide, lithium thionyl chloride, mercury, zinc air, thermal, water activated, and nickel oxyhydroxide. The method may further include providing a programming facility to set programs for autonomous control. Programming may be done by at least one of wirelessly and a direct connection to a programming interface.

In another aspect of the invention, a method of gutter cleaning, may include providing a gutter-cleaning device, including: a housing, the housing configured to fit into a gutter; and an impeller, disposed at an end of the housing and driven by an impeller drive facility; and providing a placement pole, optionally telescoping, operably connected to the gutter-cleaning device, including: an impeller drive facility electrically connected to an impeller; optionally, a transport facility for transporting the housing along the gutter; and an energy storage facility electrically connected to the impeller drive facility and the transport facility for providing power. In the method, the impeller may be removably connected. In the method, the impeller drive facility may include a transmission. In the method, the impeller may be a rotating impeller. In the method, the impeller may be configured to remove debris from a gutter. In the method, the housing may include an energy storage facility. The method may further include providing a control facility. The control facility may comprise an antenna. The control facility is a remote control facility. The remote control facility may include a wireless communication facility. In the method, the transport facility may include a rotational transport facility. The method may further include housing a portion of the impeller in an impeller chute, wherein debris may be rotated against the chute by the impeller prior to ejection from the gutter. The method may further include disposing debris tines at one or both ends of the gutter-cleaning device to loosen and lift matted debris from the bottom and sides of the gutter into the impeller. The debris tines may be formed from at least one of metal, wood, plastic, and molded elastomer. The debris tines may be coated with a solid debris removal solvent. In the method, the impeller may be formed from at least one of a molded elastomer, neoprene, rubber, plastic, and an electrostatic cloth. In the method, the impeller may be at least one of a helical-bristled brush, a flexible paddle, a full stiff bristle brush, a spiral stiff bristle brush, a wire brush, a dethatching brush, an alternating paddle brush, a flexible bucket, a multiply-vaned impeller, and an alternating flexible blade. In the method, the transport facility may be at least one of a wheel, a snake drive, a worm drive, a crab or walking drive, a scoot-and-compress or accordion drive, and a string of beads drive. The wheel may be at least one of a tractor/tread wheel and tractor treads/tracks, finned hemispherical wheels, rubber wheels, vulcanized wheels, plastic wheels, molded elastomer wheels, and metal wheels. The wheel may be connected through an axle to a drive shaft. The method may further include disposing a vision system disposed on the housing for facilitating navigation and programming of the device. The vision system may include a solid state camera, a camera lens, and a video signal electronics module. The method may further include providing a moisture sensor for detecting prohibitive levels of moisture in a gutter. In the method, the transport facility and the impeller drive facility may each control both transport and impellers. The method may further include providing at least one of an on-board tool or attachment, a downspout cleaning tool, an air hose attachment, a water hose attachment, a vacuum facility, and a weed whacker attachment. In the method, the vacuum facility may provide a vacuum through at least one of the impellers, the impeller vane attachment point, the housing, and a vacuum hose attachment. In the method, the impeller drive facility may be at least one of a reversing gear motor, an electric motor, a gasoline- or biofuel-powered internal combustion engine, and a solar-powered motor. In the method, the transport facility may be at least one of a reversing gear motor, an electric motor, a gasoline- or biofuel-powered internal combustion engine, and a solar-powered motor. In the method, the housing may be formed from at least one of metal, plastic, molded elastomer, weather-resistant materials, water-resistant materials, solvent-resistant materials, temperature-resistant materials, shock-resistant materials, and breakage-resistant materials. The method may further include providing a navigation system to facilitate autonomous control of the device. The navigation system may be integrated with at least one of a proximity sensor, a vision system, a programming facility, and a moisture sensor. The method may further include connecting an energy storage facility to the transport and impeller drives for providing power. The energy storage facility may be at least one of a battery, a gasoline fuel or biofuel tank, and a solar panel. The battery may be at least one of rechargeable, disposable, lead-acid, gel, nickel cadmium, nickel metal hydride, lithium ion, zinc carbon, zinc chloride, alkaline, silver oxide, lithium ion disulphide, lithium thionyl chloride, mercury, zinc air, thermal, water activated, and nickel oxyhydroxide. The method may further include providing a programming facility to set programs for autonomous control. Programming may be done by at least one of wirelessly and a direct connection to a programming interface. In the method, the placement pole may be removably associated with the gutter-cleaning device.

These and other systems, methods, objects, features, and advantages of the present invention will be apparent to those skilled in the art from the following detailed description of the preferred embodiment and the drawings. All documents mentioned herein are hereby incorporated in their entirety by reference.

BRIEF DESCRIPTION OF THE FIGURES

The invention and the following detailed description of certain embodiments thereof may be understood by reference to the following figures.

DETAILED DESCRIPTION

Throughout this disclosure the phrase "such as" means "such as and without limitation." Throughout this disclosure the phrase "for example" means "for example and without limitation." Throughout this disclosure the phrase "in an example" means "in an example and without limitation." Throughout this disclosure the phrase "in another example" means "in another example and without limitation." Generally, any and all examples may be provided for the purpose of illustration and not limitation.

The present invention may comprise a robotic drainage channel (gutter) cleaning system. The cleaning system may comprise a remotely operated device for cleaning drainage channels, or "gutters" and methods thereof. Gutter cleaning may involve removing debris, such as leaves, bark, twigs, nut shells, nuts, airborne matter, bird's nests, ice, water, foreign objects, and any other matter that may accumulate in a gutter. The gutter cleaning system may comprise an impeller, a chute at each end of the device that may facilitate the debris removal action, a impeller power module that drives the impeller, a transport mechanism that moves the device either way along the trough of the gutter, a impeller power module that drives the transport mechanism (which may be the same as for the impeller if so designed), an energy storage system, a communication module, a spring mounted device placement hook/visual indicator, a handheld remote controller, a placement mechanism, and the like. A user of the gutter cleaning system may deploy a gutter-cleaning device 104 into a gutter with the use of a pole with a hook on its end. A wireless remote control may permit the user to move the gutter-cleaning device 104 along the length of the gutter while the device disposes accumulated debris out of the gutter.

Figure 1:
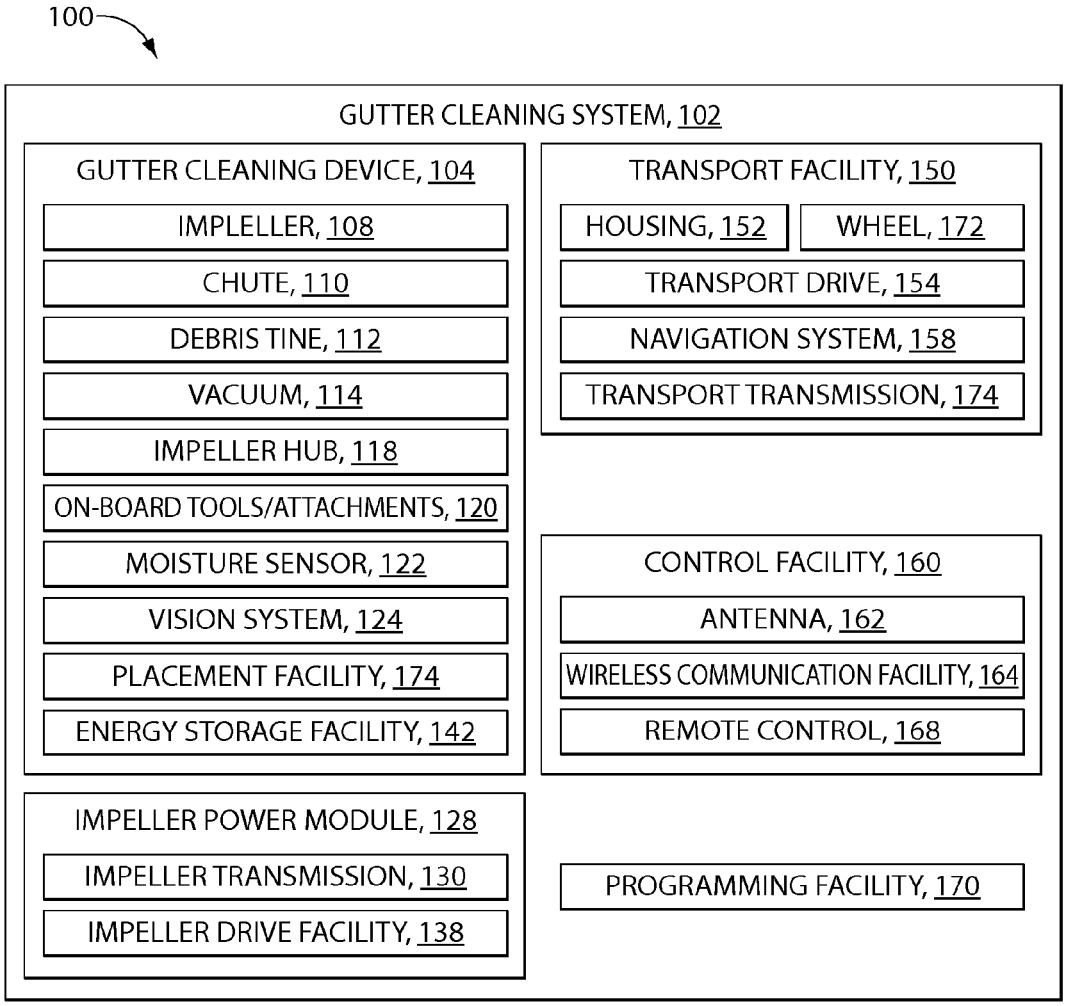
FIG. 1 depicts a system for gutter cleaning.

Referring to FIG. 1, a gutter cleaning system 102 may comprise gutter-cleaning device 104, a transport facility 150, an impeller power module 128, a control facility 160, and a programming facility 170. The gutter-cleaning device 104 may comprise an impeller 108, a chute 110, a debris tine 112, a vacuum 114, an impeller hub 118, on-board tools or attachments 120, a moisture sensor 122, a vision system 124, a placement facility 174, and the like. An impeller power module 128 may comprise an impeller transmission 130, an impeller drive facility 138, an energy storage facility 142, and the like. A transport facility 150 may comprise a housing 152, a transport drive 154, a navigation system 158, a wheel 172, a transport transmission 174, and the like. A control facility 160 may comprise an antenna 162, a wireless communication facility 164, a remote control 168, and the like. A programming facility 170 may enable programming and re-programming the gutter-cleaning device 104.

Figure 2:
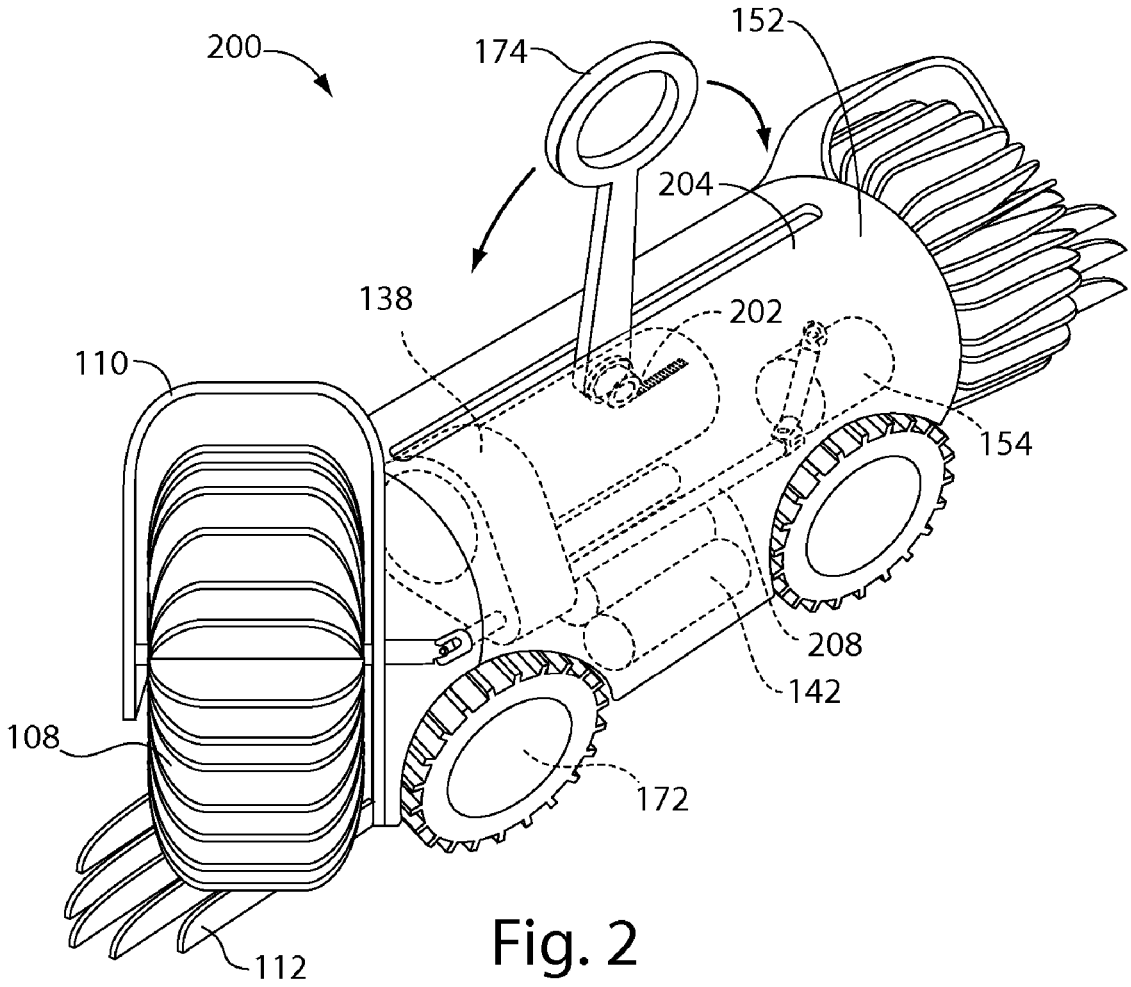
FIG. 2 is a perspective view of the gutter cleaning system showing the internal mechanical system elements.
Figure 8:
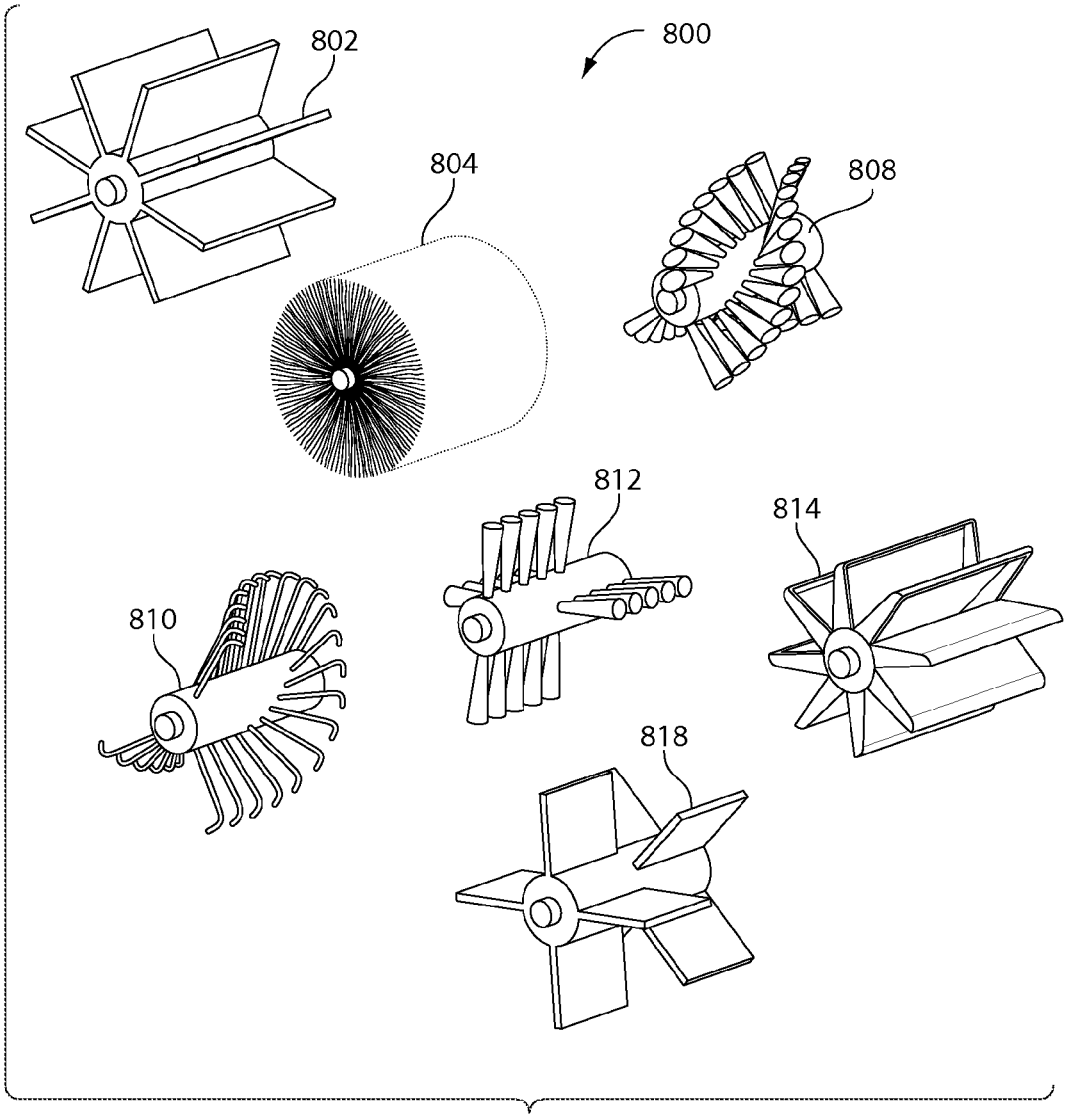
FIG. 8 is an illustration showing the range of impellers that may accomplish gutter cleaning.

Referring now to FIG. 2, an impeller 108 located at an end of a gutter-cleaning device 104, a chute 110 housing for the impeller, debris tines 112, an impeller drive facility 138, a housing 152, a transport drive 154, a wheel 172, an energy storage facility 142, a placement facility 174, and the like. The gutter-cleaning device 104 is configured and disposed to move along the length of a gutter while disposing the accumulated debris out of the gutter. The impeller 108 is configured to capture gutter debris for removal from the gutter. The impeller 108 may be connected to at least one end of the gutter-cleaning device 104. In some embodiments, an impeller 108 may be located on both ends of a gutter-cleaning device 104, attached by an impeller hub 118 to an impeller drive shaft 208. An energy storage facility may provide power to an impeller drive facility 138 to rotate the impeller about its central axis. As the impeller 108 rotates, the impeller vanes 702 may capture accumulated debris either between the vanes 702 or against an impeller chute 110 disposed around a portion of the impeller. The rotational torque of the impeller 108 may move the captured debris against the surface of the chute 110 or the gutter wall. At the top end of the chute 110 or the gutter, the gutter debris may be discharged at a high enough velocity such that the debris may clear the outside wall of the gutter. Once clear of the gutter, the debris may fall to the ground, may be captured in a disposal bag attached to the gutter, may be captured in a disposal bag attached to the gutter-cleaning device 104, or the like. The impeller 108 may be easily removable to facilitate cleaning, replacement, storage, shipping, disposal, and the like. In an embodiment, the impellers 108 may comprise many different materials such as molded elastomer, neoprene, rubber, plastic, electrostatic cloth, and the like. Referring to FIG. 8, in an embodiment, the impellers 108 may comprise many different impeller configurations, such as a helical-bristled brush, flexible paddles 802, a full stiff bristle brush 804, a spiral stiff bristle brush 808, a wire (dethatching) brush 810, an alternating paddle brush 812, a flexible bucket 814, an alternating flexible blade 818, and the like. In embodiments, the impellers 108 on one or both ends of the device 104 may be detachable and interchangeable with any impeller configuration. The impeller 108 may have multiple impeller vanes 702 disposed about a central attachment point. Each impeller vane 702 may be flexible to facilitate deflection under gutter cross braces and movement against chute 110, gutter walls, and gutter floor. In an embodiment, the impellers may be sized to span the gutter, span portions of debris, or a combination thereof, such as four-inches in diameter and 3 inches in length. In an embodiment, the impellers may be compliant enough such that they deform under pressure, such as to 0.75" inward with one pound of force. In an embodiment, the impeller 108 may comprise a vacuum facility 114 disposed within the gutter-cleaning device 104 and a vacuum motor disposed within the housing 152. The vacuum facility 114 may provide suction through the impellers, the impeller vane attachment point, the housing 152, and the like in order to loosen debris from the gutter. In an alternative embodiment, the impeller head may be replaced with a vacuum hose attachment. As the gutter-cleaning device 104 moves along the gutter, the vacuum 114 attachment may vacuum up debris and remove it from the gutter. Removal may be through a collection hose attached to a collection bag, a yard waste receptacle, a mulching or composting system, and the like. In this embodiment, a vacuum 114 motor may be disposed within the housing 152 or in a separate structure.

In an embodiment, the chute 110 may be a housing for at least a portion of the impeller 108. In embodiments, the chute 110 may not protrude above the top line of the gutter-cleaning device 104, may not interfere with gutter cross braces, may be deformable to permit passage under gutter cross braces, and the like.

In an embodiment, the debris tines 112 may be connected to one or both ends of the gutter-cleaning device 104. The debris tines 112 may be configured and disposed to loosen and lift matted debris from the bottom and sides of the gutter into the impeller. The debris tines may be attached to a lower part of the housing 152 or the sides of the housing 152 at the ends of the gutter-cleaning device 104. The debris tines 112 may be formed from almost any material, including metal, wood, plastic, molded elastomer, and the like. To facilitate debris loosening, the debris tines 112 may be coated with a solid debris removal solvent. Before placement of the gutter-cleaning device 104 into the gutter, the solid debris removal solvent may be activated by placing water on the debris tines 112. In an alternative embodiment, debris removal solvent may be disposed within the housing 152. When the impellers 108 may be activated, some solvent may be applied to the gutter surface using a spray, a simple gravity fed system, and the like.

In an embodiment, the impeller drive module 138 may be configured and disposed to drive the impeller 108 with any necessary rotational speed and torque. The impeller drive module 138 may be coupled to the impeller and housed within the housing 152. In some embodiments, the impeller drive module 138 may comprise a motor or engine and a speed/torque modifying transmission 130. The motor may be any one of a reversing gear motor, an electric motor, a gasoline- or biofuel-powered internal combustion engine, a solar-powered motor, and the like. In an embodiment, the motor may be a 12 Volt DC single speed motor with transfer gearing to an impeller drive shaft 208. Motor cooling may be on a top surface of the gutter-cleaning device 104 and may minimize fluid entry to the device. In some embodiments, the motor may be mechanically coupled to the drive transmission 130 such that the rotational output of the drive motor 138 is a rotational input to the drive transmission 130. The rotational output of the impeller transmission 130 may rotate the wheel 152 about its central axis.

In an embodiment, the impeller drive module 138 may comprise a motor or engine connected directly to an output without any intervening speed/torque modifying transmission 130. In an embodiment, the impeller drive facility 138 may operate at 400 rpm@300 in.lbs. of torque. In an embodiment, the motor may work with both the impeller drive module 138 as well as the transport drive 154.

In an embodiment, the impeller transmission 130 comprises transfer gear driving. A gear may be coupled to a selector fork with a transfer shaft delivering power to the wheels 152 with power take-off's.

In an embodiment, a transport facility 150 may comprise a housing 152, a transport drive 154, a navigation system 158, a wheel 172, and the like. The housing 152 may be formed from any suitable material, such as metal, plastic, molded elastomer, and the like. In an embodiment, the housing 152 materials may be weather-resistant, water-resistant, solvent-resistant, temperature-resistant, shock-resistant, breakage-resistant, and the like. All of the components of the gutter-cleaning device 104, including at least the housing 152, impellers 108, debris tines 112, on-board tools/attachments 120, control facility 160, transport facility 150, and the like may be easy to clean. The housing 152 may be able to withstand all manners of environmental phenomena and exposure. The housing 152 may be able to withstand falls from the gutter onto a surface, such as concrete, asphalt, stone, grass, roofing, and the like. The housing 152 may provide weight to the gutter-cleaning device 104 such that the device may exert any necessary force on the impeller 108 to detach debris. In some embodiment, the gutter-cleaning device 104 may not be so heavy as to negate the possibility of lifting the gutter-cleaning device 104 the height of the gutter for placement within the gutter. The housing 152 may be sized to house the internal components of the gutter-cleaning device 104. The cross sectional dimensions of the housing 152 and gutter-cleaning device 104 may be limited by the size of a gutter, such as no more than 2.75" high and 3.0" wide.

In an embodiment, the transport drive 154 may be connected to at least one wheel 172, a snake drive, a worm drive, a crab or walking drive, a scoot-and-compress or accordion drive, a string of beads drive, other translation mechanisms, and the like. The transport drive 154 may be housed within the housing 152 of the gutter-cleaning device 104. The wheels may be tractor/tread wheels and tracks, finned hemispherical wheels, rubber wheels, vulcanized wheels, and the like. The transport drive 154 may be configured and disposed to provide rotational speed and torque to the wheel 172 or other transport facility 150 in a sufficient amount to drive the gutter-cleaning device 104. The transport drive 154 may comprise a motor or engine and a transmission 174. The motor may be any one of a reversing gear motor, an electric motor, a gasoline- or biofuel-powered internal combustion engine, a solar-powered motor, and the like. In an embodiment, the motor may be a 12 Volt DC single speed motor with transfer gearing to an impeller drive shaft 208. Motor cooling may be on a top surface of the gutter-cleaning device 104 and may minimize fluid entry to the device. The transmission 174 may be a speed/torque modifying transmission. The transport drive 154 may have a static or variable speed setting. The speed setting may be set in the factory or by a remote control 168. For example, the speed may be set to 4 inches per second. In another example, a user may use a remote control 168 to modify the speed from a fast speed to a slow speed. The transport drive 154 may work with the wheel 172 or alternate translation mechanisms to move the gutter-cleaning device 104 within the gutter in either direction, such as forwards and backwards.

In an embodiment, the wheel 172 may be attached to an axle. The axles may be located fore and aft and may be transversely connected to one another. The axles may be connected through a drive shaft 208.

In an embodiment, the navigation system 158 may facilitate navigation of the gutter-cleaning device 104 in the gutter. In embodiments, the navigation system 158 may comprise a proximity sensor, may be integrated with a vision system 124, may be integrated with a moisture sensor 122, may be integrated with a programming facility 170, and the like. For example, the gutter-cleaning device 104 may have a proximity sensor on an end of the device to determine if the device is about to reach a gutter wall or turn. The gutter-cleaning device 104 may come to a halt or automatically reverse direction if it senses that it has reached the end of its travel. If the sensor detects that there may be a turn in the gutter, the gutter-cleaning device 104 may turn corner and continuing its gutter cleaning. In an embodiment, the gutter-cleaning device 104 may be segmented to facilitate turning the corner. In an embodiment, certain drives may facilitate corner turning, such as the accordion drive or the worm drive. In another example, a moisture sensor 122 disposed on the housing 152 of the device 104 may sense when water levels may be prohibitive to operation of a non-watertight housing 152. The navigation system 158 may receive a signal from the moisture sensor 122 and modify, continue, or cease operation of the device 104. The navigation system 158 may also be integrated with a vision system 124, as discussed below.

Continuing to refer to FIG. 2, an energy storage facility 142 may be housed within the housing 152 of the gutter-cleaning device 104 and electrically connected to the motors or engines of the impeller drive facility 138 and transport drive 154. The energy storage facility 142 may be a battery. The battery may be rechargeable, disposable, lead-acid, gel, nickel cadmium, nickel metal hydride, lithium ion, zinc carbon, zinc chloride, alkaline, silver oxide, lithium ion disulphide, lithium thionyl chloride, mercury, zinc air, thermal, water activated, nickel oxyhydroxide, and the like. For example, a battery pack may supply 12 Volts DC at 2.2 Amp Hr. The rechargeable battery may comprise a recharging or docking station. The battery may be removable for docking or the entire device may be docked. In an embodiment, the docking station may be disposed at the end of a gutter. In this example, the gutter-cleaning device 104 may self-dock once a cleaning cycle is complete, if the battery is low, if directed to dock by a signal from a remote control 168, and the like. An audible alert may indicate that the battery power level is low.

In an embodiment, the energy storage facility 142 may be a gasoline fuel or biofuel tank. The energy storage facility 142 may be a solar panel. In embodiments, there may be no energy storage facility 142 as energy may be drawn directly from a power outlet through a power cord.

In an embodiment, the gutter-cleaning device 104 may reside in the gutter. The gutter-cleaning device 104 may operate autonomously once it may be programmed. Programming may occur at the factory or may be done by a user using a programming facility 170. The device 104 may be programmed to initiate a cleaning cycle at a timed interval, if the vision system 124 determines that there may be sufficient blockage present in an image, and the like. The cycle may be programmed to run for a pre-determined amount of time. In an alternate embodiment, the vision system 125 may interface with the programming facility 170 to provide an indication that no more debris remains in the gutter and that the program may be terminated. In some embodiments, the gutter-cleaning device 104 may comprise a pressure-sensitive surface such that when no debris remains and the pressure on the impeller 108, the impeller vanes 702, the chute 110, and the like may be reduced, the program may be terminated. The programming facility 170 may be present on a remote control; programming may be accomplished wirelessly. In an alternate embodiment, the programming may be done by a direct connection to a programming interface. The gutter-cleaning device may have a connector configured to dock with a programming interface. For example, the device 104 may have a USB connector configured to allow access to a programming facility 170 when connected to a programming interface. The programming interface may a computer or the like. In embodiments, the programming interface may be a desktop application, a web page, and the like.

Figure 3:
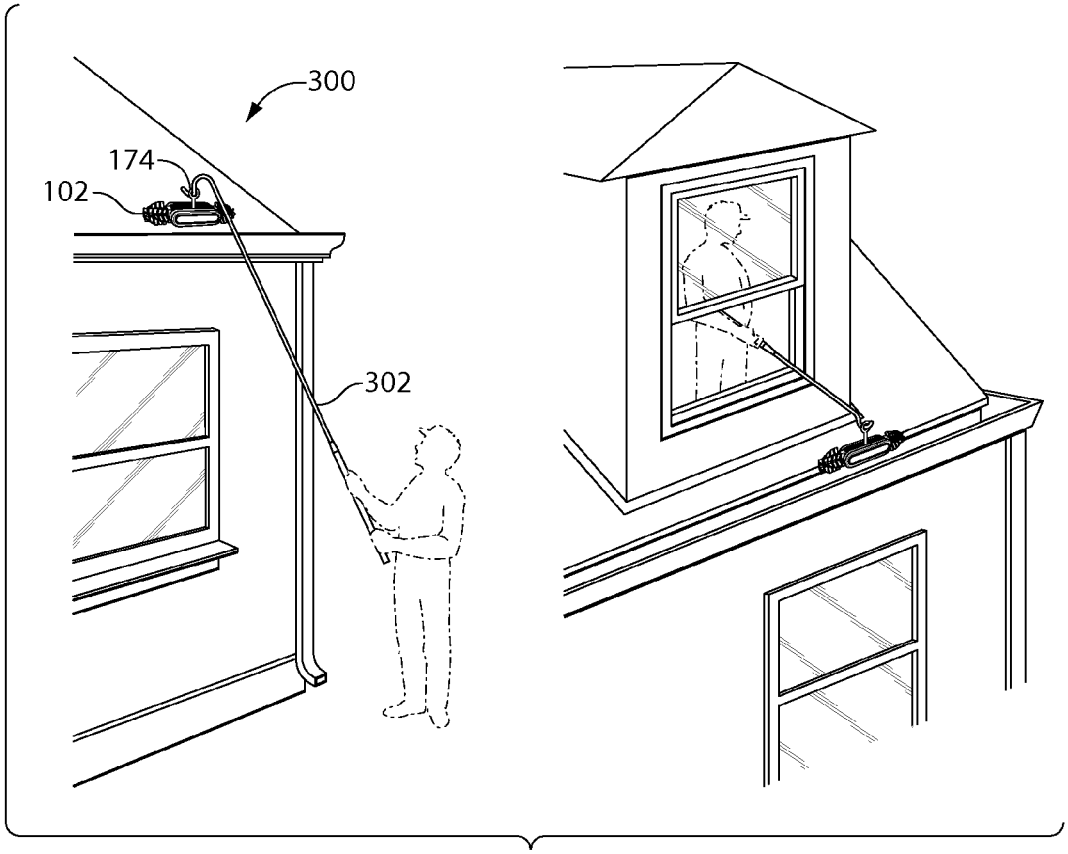
FIG. 3 is an illustration showing the placement of the gutter cleaning system into a gutter.
Figure 4:
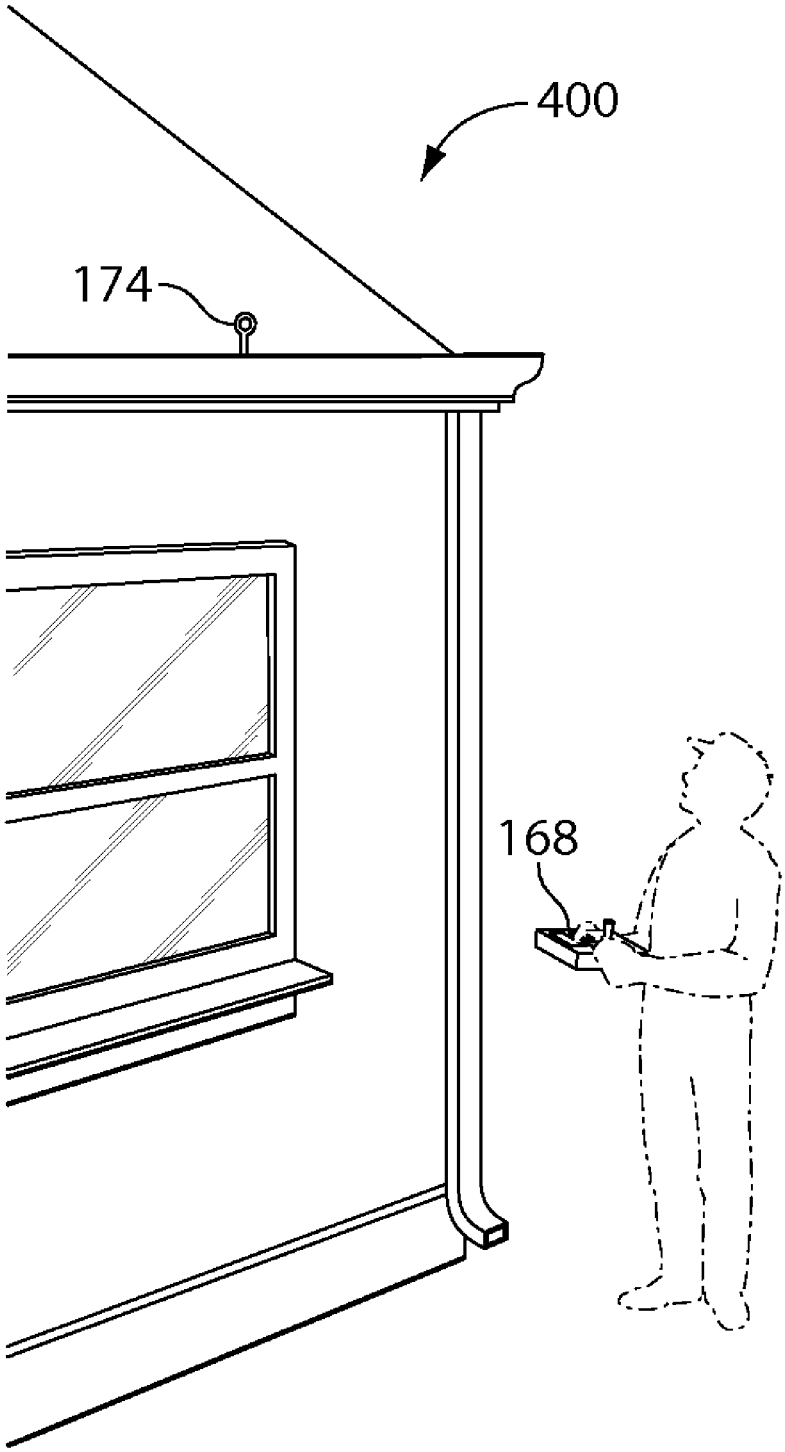
FIG. 4 is an illustration showing the control of the gutter cleaning system from the ground.

Referring now to FIGS. 3 and 4, a remotely operated wireless gutter cleaning system 102 is shown. The system 102 may include a placement pole 302, a gutter-cleaning device 104, a handheld wireless remote control unit 168, a placement facility 174, and the like. The placement facility 174 may be configured to receive an end of a placement pole 302, such as an eyelet. The system 102 may be configured to allow a user to deploy the device 102 into a gutter with the use of a placement pole 302, which may be configured with a hook on its end and remove the device once gutter cleaning may be complete. In some embodiment, the placement pole 302 is a telescoping pole. The gutter-cleaning device may be disposed and configured with a placement eyelet 174 connected to its top surface. The placement pole 302 may be telescoping to transport a gutter-cleaning device 104 to the height of the gutter and place the device within the gutter. In an alternative embodiment, the placement pole 302 may be used to lower the device 104 into the gutter from above using the placement pole 302, a tether and/or latch hook, and the like. For example, a gutter-cleaning device 104 may be lowered into a gutter from a window. In an embodiment, the placement pole 302 may comprise a battery pack, transfer gears, motors and the like. Such an embodiment may be useful for various situations where the surface to be cleaned is not horizontal. For example, the device 104 configured to attach to a placement pole 302 comprising batteries, motors, and the like may be useful for chimney cleaning. The placement eyelet 174 may be configured and disposed to receive a hook on the end of a placement pole 302, and to allow disengagement of the hook while the gutter-cleaning device 104 is in a gutter. As in FIG. 4, the placement eyelet may provide a visual cue of the location of the gutter-cleaning device 104 inside the gutter. In some embodiments, the protruding placement eyelet 174 may include a mirrored surface to provide a view of the gutter in front of and/or behind the device. The remote control 168 may permit a user to move the gutter-cleaning device 104 back and forth along the length of the gutter while the device 104 disposes of accumulated debris out of the gutter.

Continuing to refer to FIG. 2, in some embodiments, the gutter-cleaning device 104 may further include a spring loaded pivot swivel joint 202 and a flush position recess 204 for the placement facility 174. The placement facility 174 may be connected to a spring loaded pivot swivel joint 202 connected to the body of the gutter-cleaning device 104. The spring loaded pivot swivel joint 202 may be configured and disposed to keep the placement facility 174 vertical unless a lateral force may be applied to the placement facility 174. The spring loaded pivot swivel joint 202 may allow the placement facility 174 to be forced flush to the body of the gutter-cleaning device 104 when it may encounter a gutter cross brace. The body of the gutter-cleaning device 104 may be configured with a flush position 203 on either one side or both sides of the spring loaded pivot swivel joint 202. The flush position recess 204 may be configured to receive the placement facility 174 when it may encounter a side load.

Figure 5:
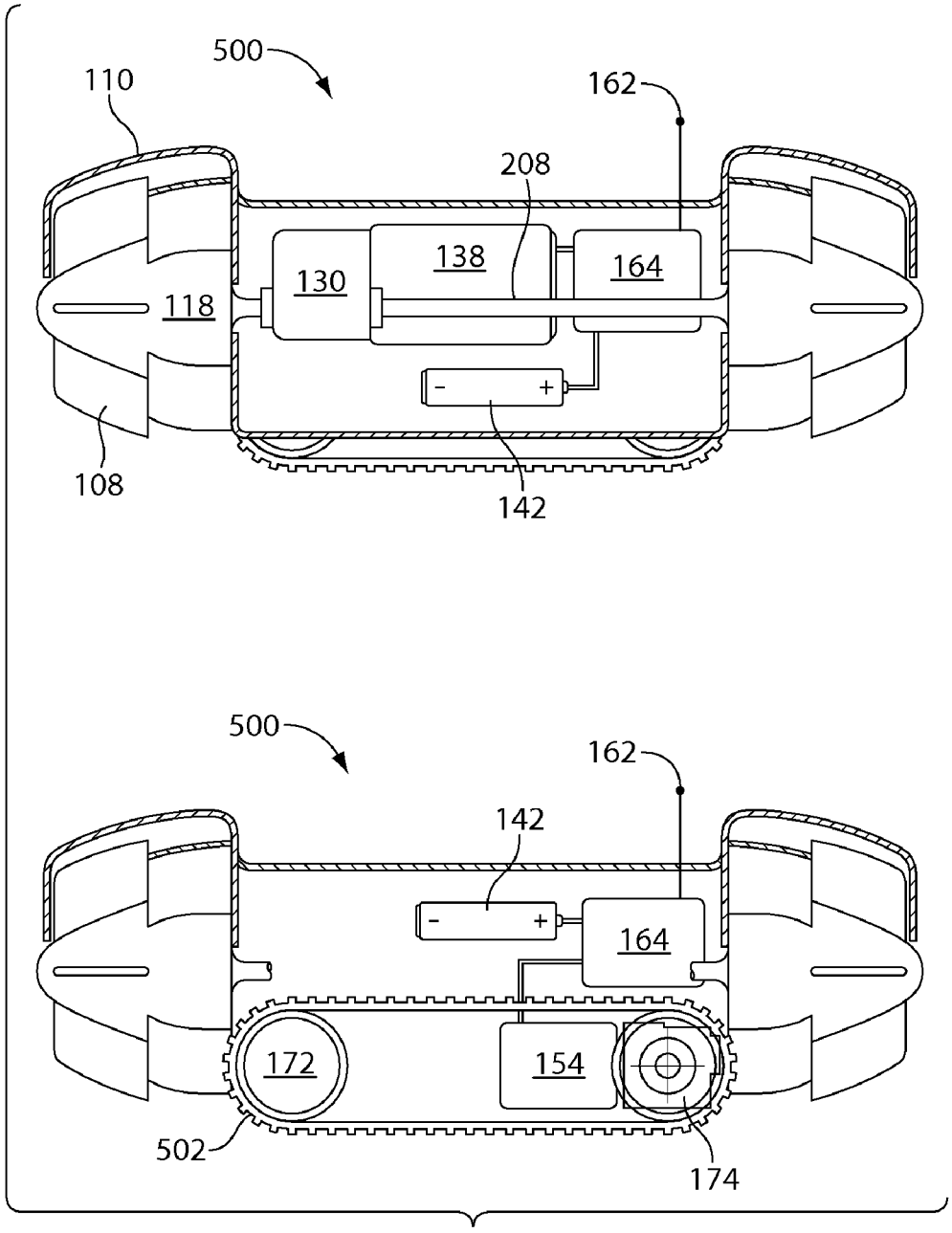
FIG. 5 is a partial section view showing the system elements.

Referring now to FIG. 5, an exemplary gutter-cleaning device may comprise an impeller 108 on both ends of the device 104, a chute 110 for each impeller 108, traction wheels 172, an energy storage facility 142, an impeller hub 118 for each impeller 108, an impeller drive motor 138, an impeller transmission 130, an impeller drive shaft 208, a wireless communication facility 164, an antenna 162, a traction tread 502, a traction drive motor 154, a traction drive transmission 174, and the like. The impeller hub 118 may be connected to the impeller 108 and mounted to an impeller drive shaft 208. The impeller drive shaft 208 may be coupled to the impeller transmission 130 and configured to extend out each end of the impeller transmission 130 to connect to each impeller hub 118 at each end of the gutter-cleaning device 104. The impeller drive motor 138 may be connected to the input of the impeller transmission 130. In some embodiments, the gutter-cleaning device 104 may comprise impeller drive motors 138 mounted within the hub 118 of each impeller 118.

Continuing to refer to FIG. 5, the wireless communication facility 164 may be electrically connected to the energy storage facility 142, the impeller drive motor 138, the traction drive motor 154, the antenna 162, and the like. The wireless communication facility 164 may be mounted within the gutter-cleaning device 104 housing 152. The wireless communication facility 164 may be configured and disposed to control the impeller 108 actuation, wheel 172 actuation, antenna 162 actuation, and the like. The wireless communication facility 164 may control power delivery from the energy storage facility 174 to the drive motors 138, 154. The wireless communication facility 164 may allow a user of a remote control 168 to change the direction of the device 104 in a gutter, change the speed of movement of the device 104, change the speed of the impellers 108, change the direction of rotation of the impellers 108, operate an on board tool/attachment 120, a vacuum 114, a moisture sensor 122, a vision system 124, and the like. The remote control 168 may have a low battery alert, such as an audible alert, a visible alert, a vibration alert, and the like. The wireless communication facility 164 may be configured to receive communication signals from a remote control 168 via the antenna 162. The antenna 162 may be electrically connected to the wireless communication facility 164 and may protrude up through the housing 152 of the gutter-cleaning device or may be disposed flush against the housing 152. In some embodiments, the antenna 162 may be integrated in the placement facility 174. In an embodiment, the wireless communication facility 164 may control the gutter-cleaning device 104 through a radio frequency link. The radio frequency link may be operable over a separation distance between the remote control 168 and the device 104. In some embodiments, the wireless communication facility 164 may include appropriate signal processing capabilities to send communication signals such as a video signal back to the remote control 168 or some other signal reception device, such as a web browser, a desktop application, and the like. In some embodiments, the antenna may be configured to receive cellular signals, a network signal, and the like, facilitating control of the device through the wireless communication facility 164 from a cellular phone, a remote control 168, a desktop application, an Internet application, and the like.

A traction tread 502 may be mounted to the traction wheels 172 on each side of the gutter-cleaning device 104. The traction tread 502 may be configured and disposed to provide traction for motive force. The traction drive motor 154 may be mechanically coupled to the traction drive transmission 174 such that the rotational output of the traction drive motor 154 is a rotational input to the traction drive transmission 174. The traction drive motor 154 and traction drive transmission 174 may be mounted within the housing 152 of the gutter-cleaning device 104. The traction drive transmission 174 may be mechanically coupled to at least one traction wheel 172 such that the rotational output of the traction drive transmission 174 may rotate the traction wheel 172 about its center axis.

Figure 6:
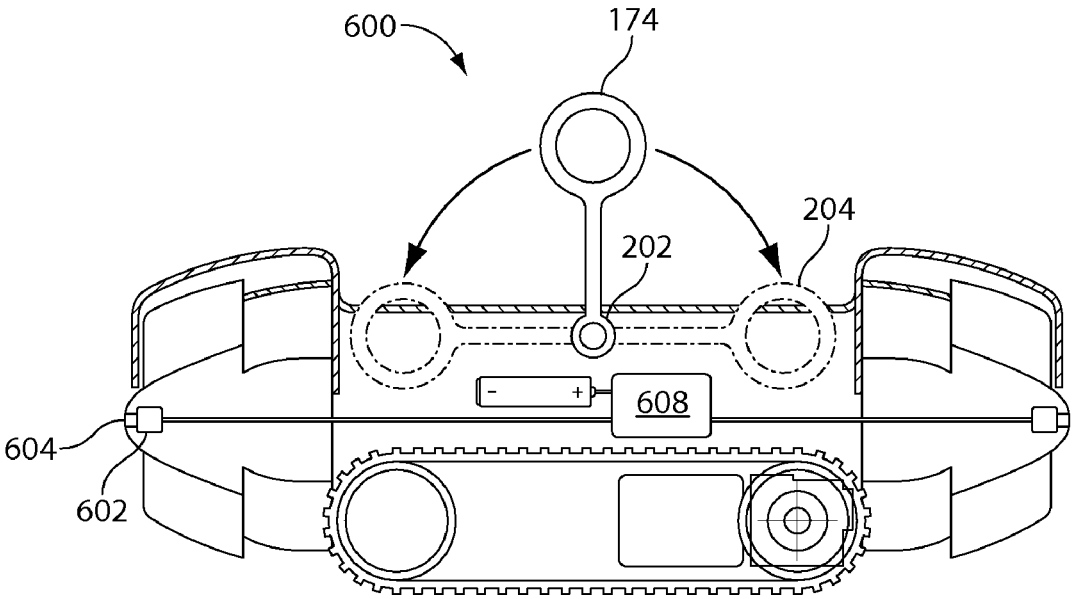
FIG. 6 is a partial section view showing the system elements.

Referring now to FIG. 6, in some embodiments a gutter-cleaning device 104 may comprise vision system 124. The vision system 124 may comprise a solid state camera 602, a camera lens 604, and a video signal electronics module 608. A solid state camera 602 may be mounted in the front of each impeller hub 118, optionally on a center axis. A camera lens 604 may be mounted directly in front of the solid state camera 602 and may be configured and disposed to focus an image for the solid state camera 602. The camera lens 604 may also protect the solid state camera 602 from being damaged by debris. The solid state camera 602 and the video signal electronics module 608 may interact to enable wireless transmission of a video signal. Images may be transmitted to a remote control 168 or some other signal reception device. Having seen the images, a user may modify, continue, or cease the operation of the device 104. For example, if the images indicate that the gutter-cleaning device 104 is nearing a gutter wall, a user may slow down the device 104 then turn it off. If the images indicate that the gutter still has debris to clear, the user may continue to operate the gutter-cleaning device 104 in at least those portions of the gutter that still retain debris. Images may be used by a navigation system 158 to automatically modify, continue, or cease the operation of the device 104. The navigation system 158 may process the images to determine if the system 158 should modify, continue, or cease the operation of the device 104. In an example, the navigation system 158 may be used to navigate a right hand turn in the gutter.

Figure 7:
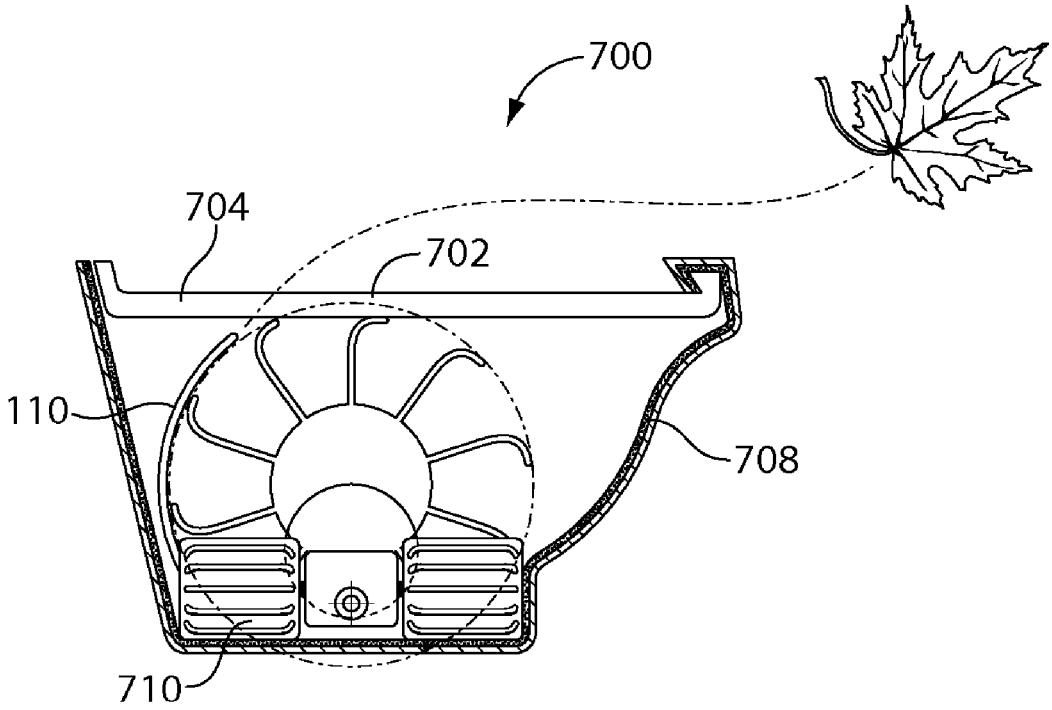
FIG. 7 is a cross sectional view showing the operation within the gutter.

Referring now to FIG. 7, a cross sectional view of the gutter-cleaning device 104 is shown within a gutter. The gutter-cleaning device 104 may comprise flexible impeller vanes 702, compliant treads 710, and the like. The gutter may comprise a sidewall 708 and at least one cross brace 704. The impeller chute 110 may be configured and disposed such that it may be lower in height then the cross braces 704 of the gutter. In some embodiment, the impeller chute 110 may be at least the height of the cross braces 704 and may be compliant such that it may deflect under the cross braces 704. The flexible impeller vanes 702 may be configured and disposed such that they may deflect under the cross braces 704 and/or against the bottom surface of the gutter. The shape and form factor of the impeller chute 110 may be one factor that may determine the average trajectory of the ejected debris.

Figure 9:
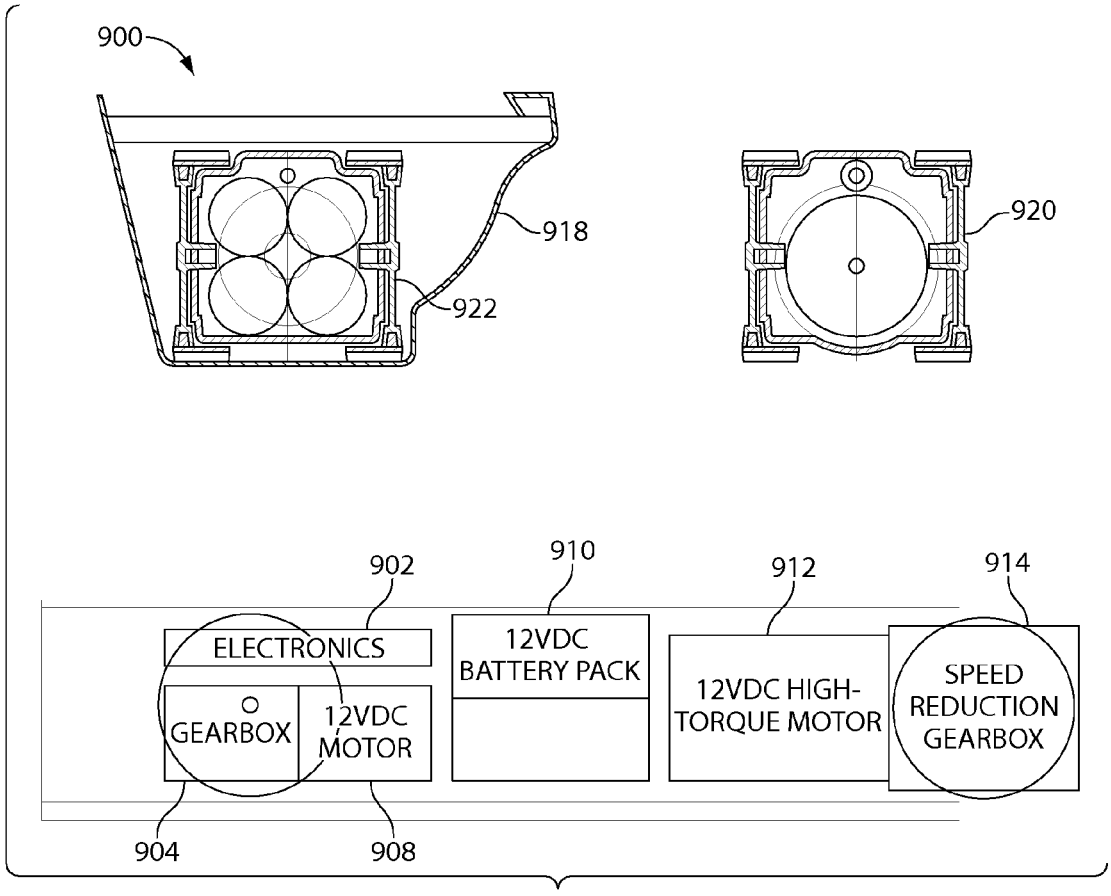
FIG. 9 depicts a cross section of an exemplary gutter-cleaning device.

Referring now to FIG. 9, a gutter profile 918 and an exemplary gutter-cleaning device 104 cross section 920, 922 are depicted. For example, a gutter-cleaning device 104 may comprise electronics 902, a gearbox 904, a 12 VDC motor 908, a 12 VDC battery pack 910, a 12 VDC high-torque motor 912, a speed reduction gearbox 914, and the like.

Figure 10:
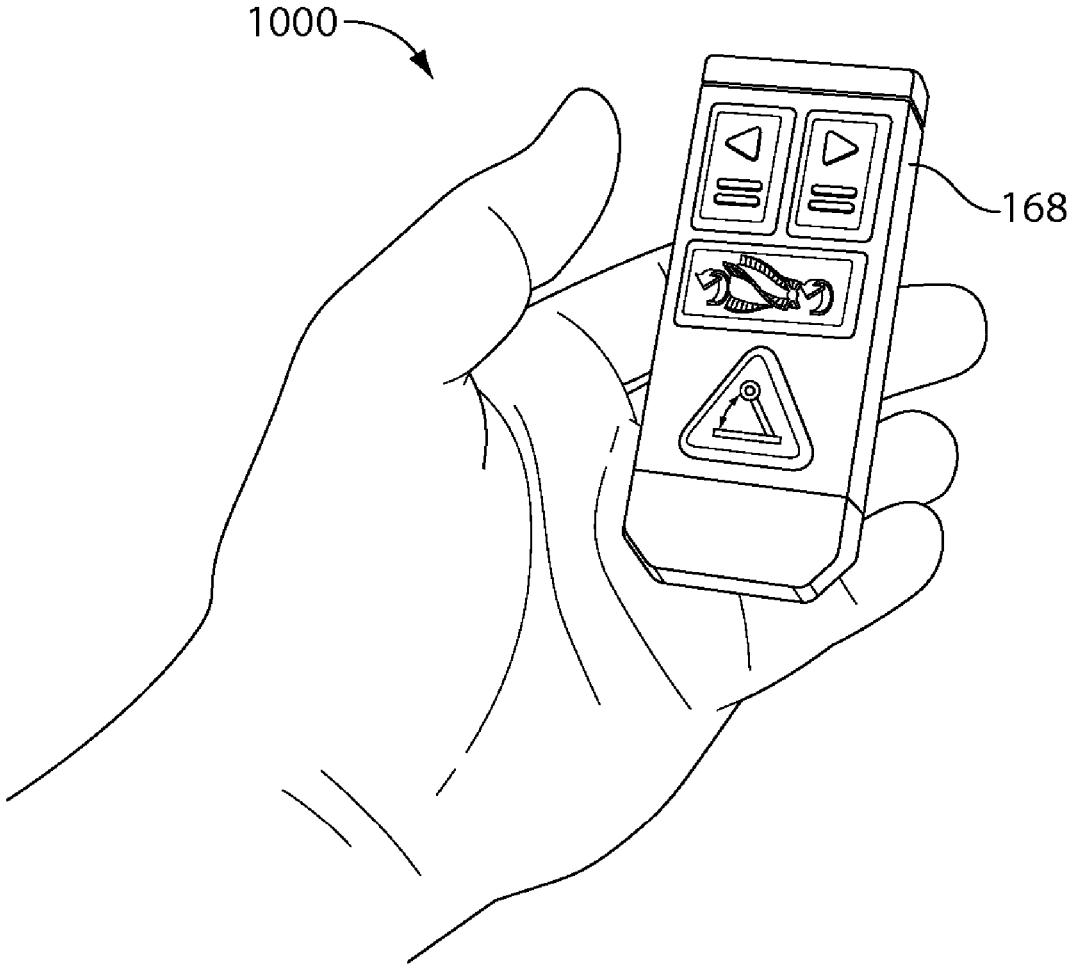
FIG. 10 depicts a gutter-cleaning device remote control.

Referring to FIG. 10, an exemplary handheld remote control 168 comprising forward and reverse direction buttons, impeller 108 actuation and speed button, placement facility 174 retraction button, and the like.

Figure 11:
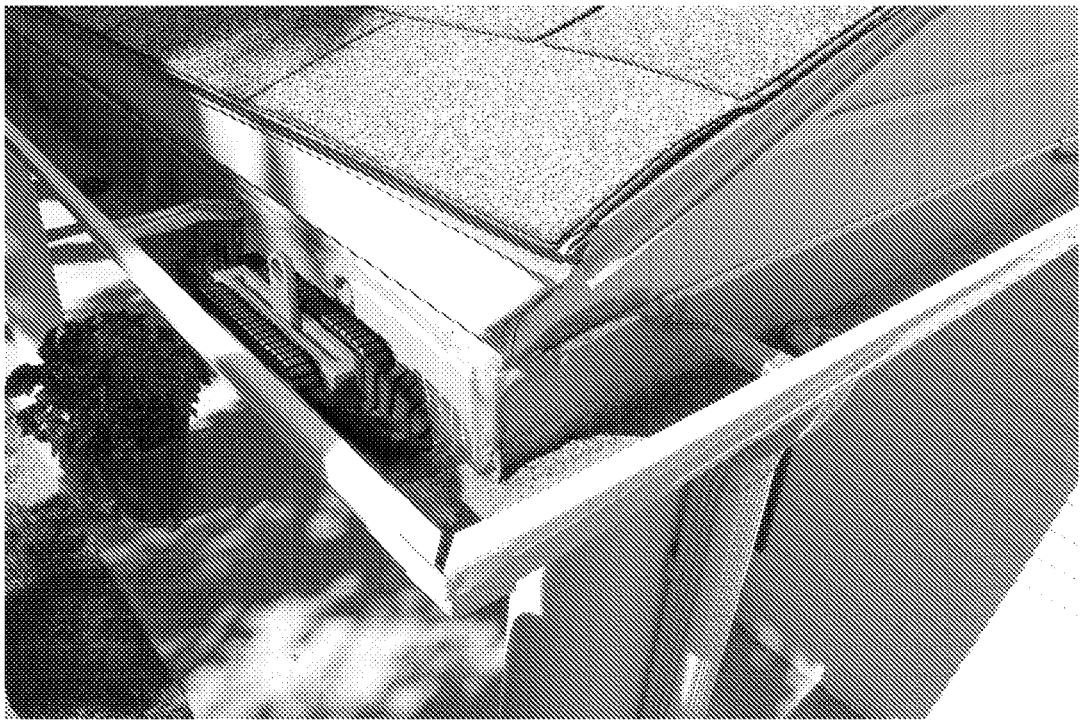
FIG. 11 depicts a gutter-cleaning device disposed in a gutter.

Referring to FIG. 11, an exemplary gutter cleaning is disposed in a gutter.

Figure 12:
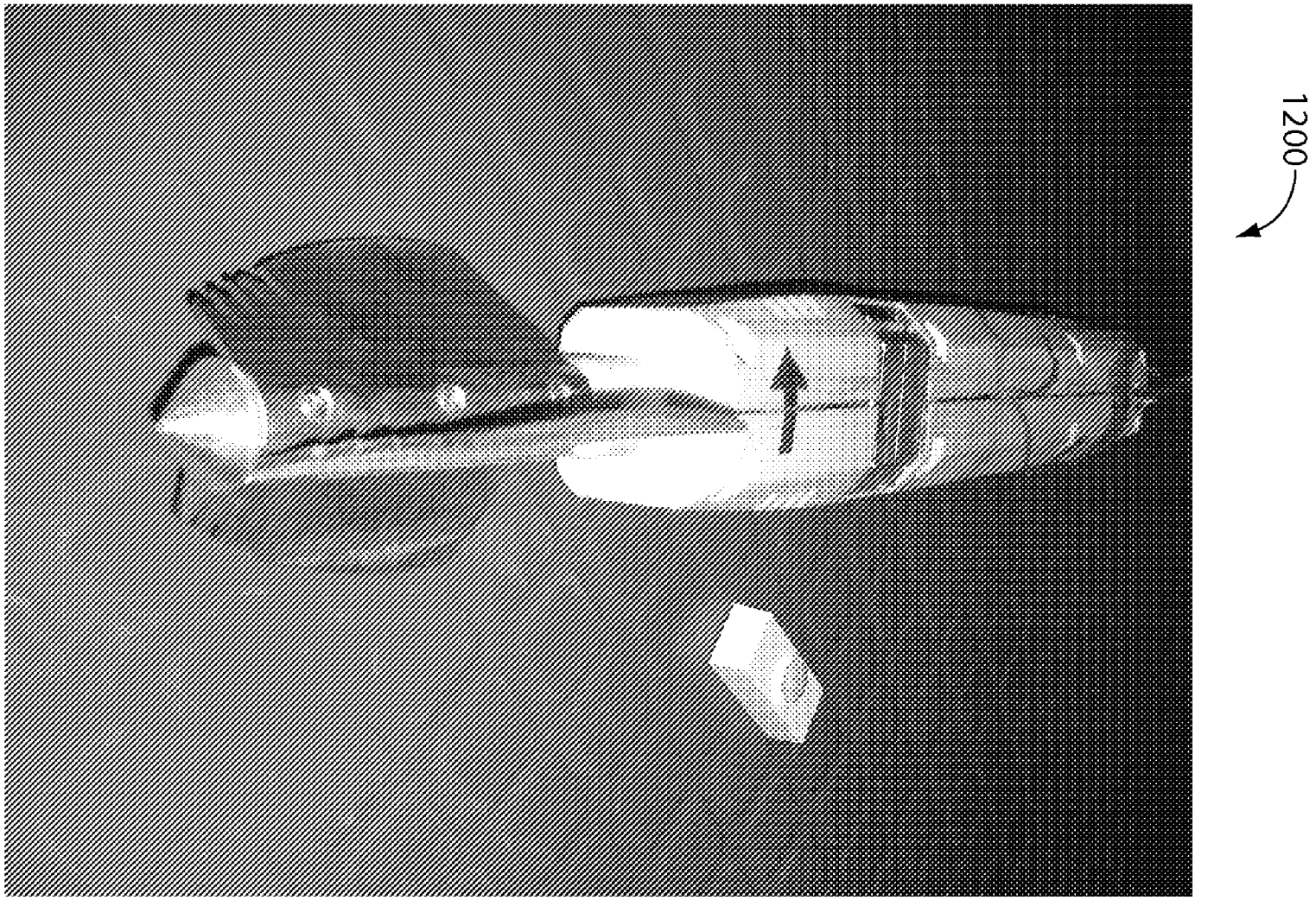
FIG. 12 depicts a gutter-cleaning device.
Figure 13:
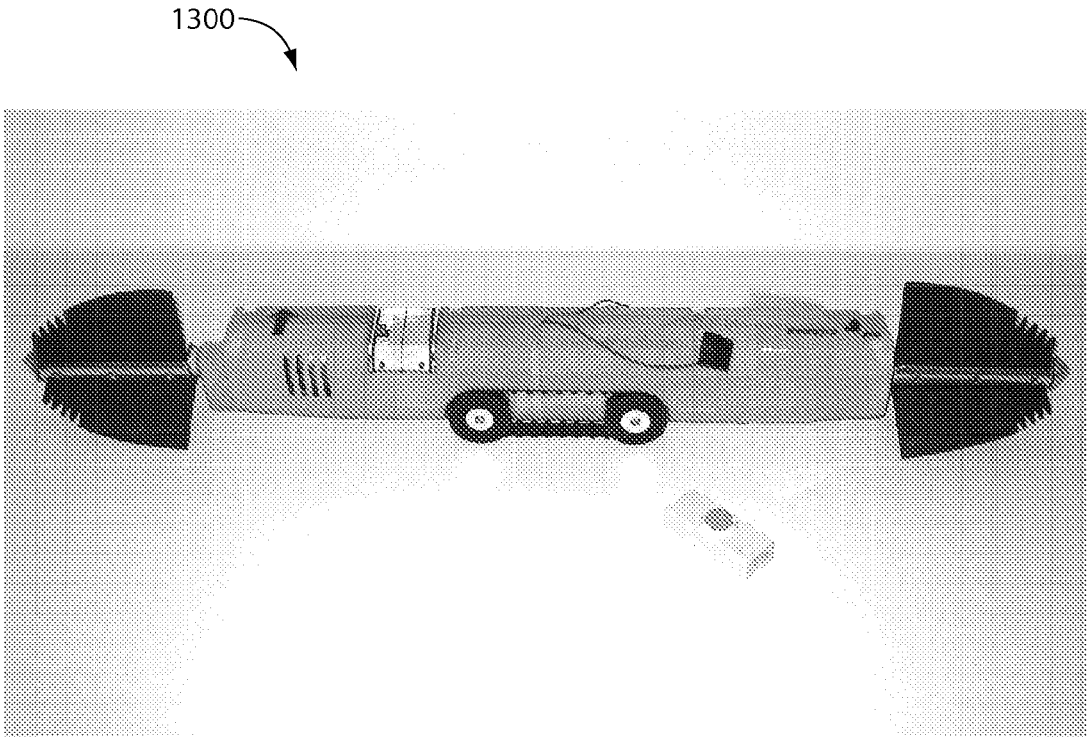
FIG. 13 depicts a gutter-cleaning device.
Figure 14:
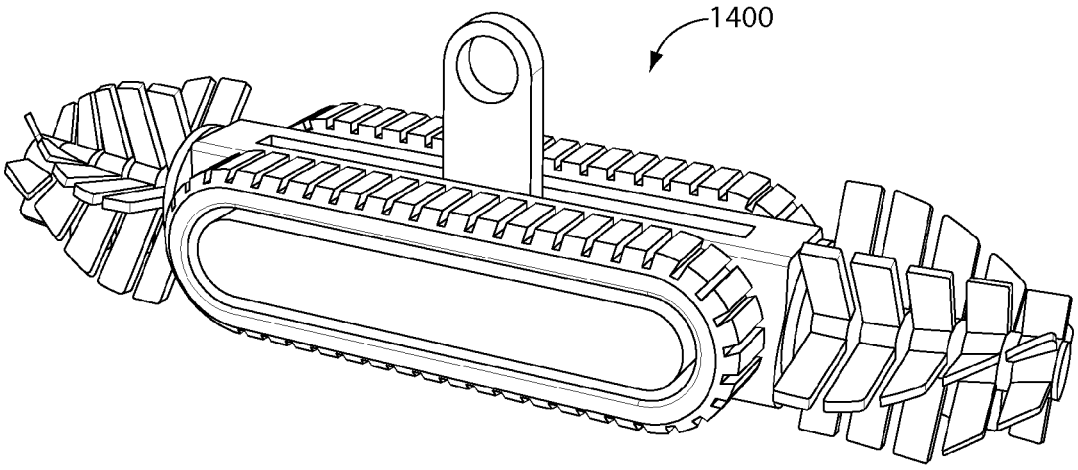
FIG. 14 depicts a gutter-cleaning device.

Referring to FIGS. 12, 13, and 14, exemplary gutter-cleaning devices are depicted.

Figure 15:
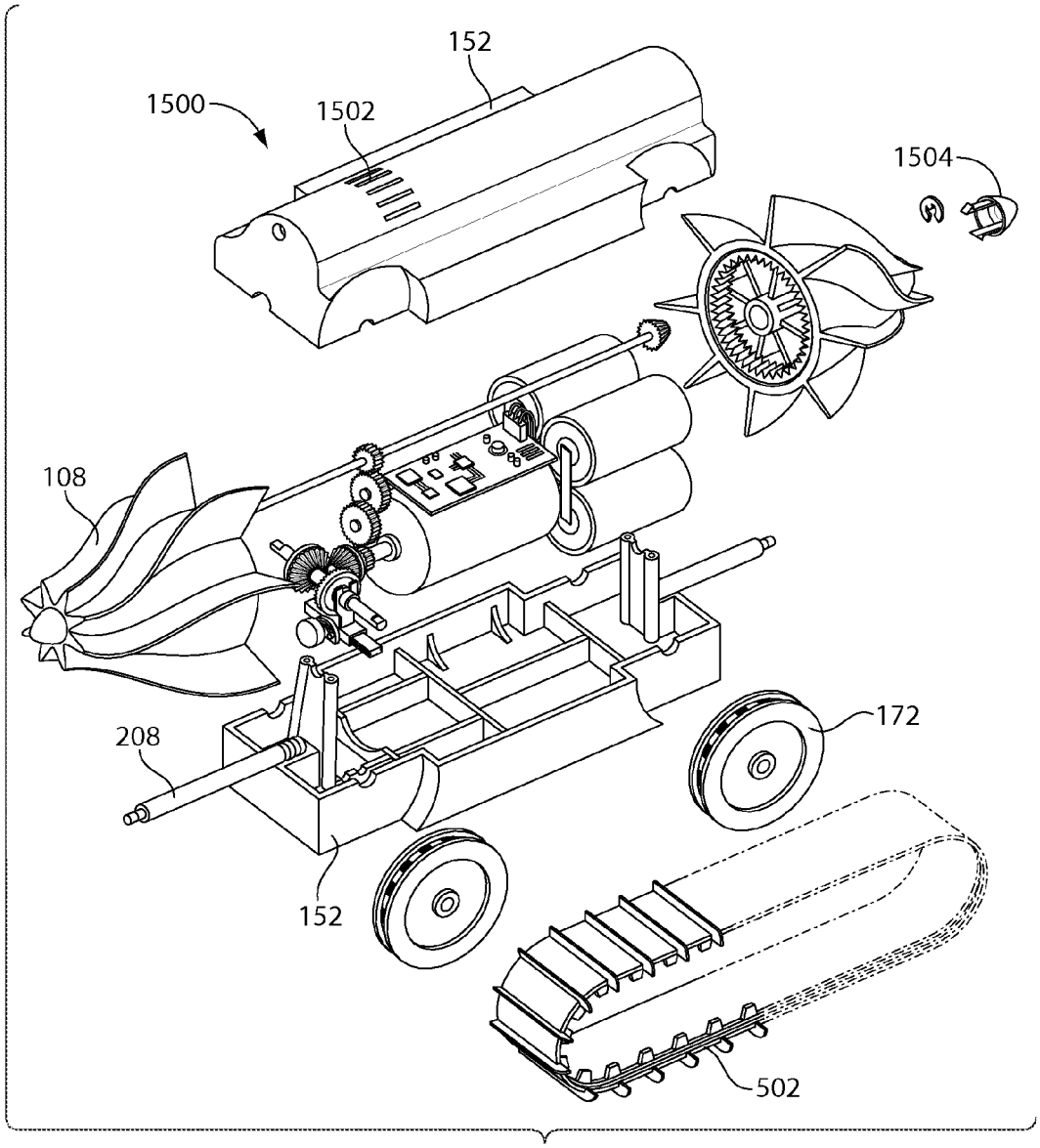
FIG. 15 depicts a cutaway view of a gutter-cleaning device.

Referring to FIG. 15, an exemplary gutter-cleaning device is shown in a cut-away view so that the internal elements are exposed. In this example, the gutter-cleaning device may comprise an impeller 108, a drive shaft 208, a housing 152, a wheel 172, an impeller end-cap 1504 to facilitate securing and removal of the impeller 108, traction tread 502, an air vent 1502 in a portion of the housing 152, and the like.

Figure 16:
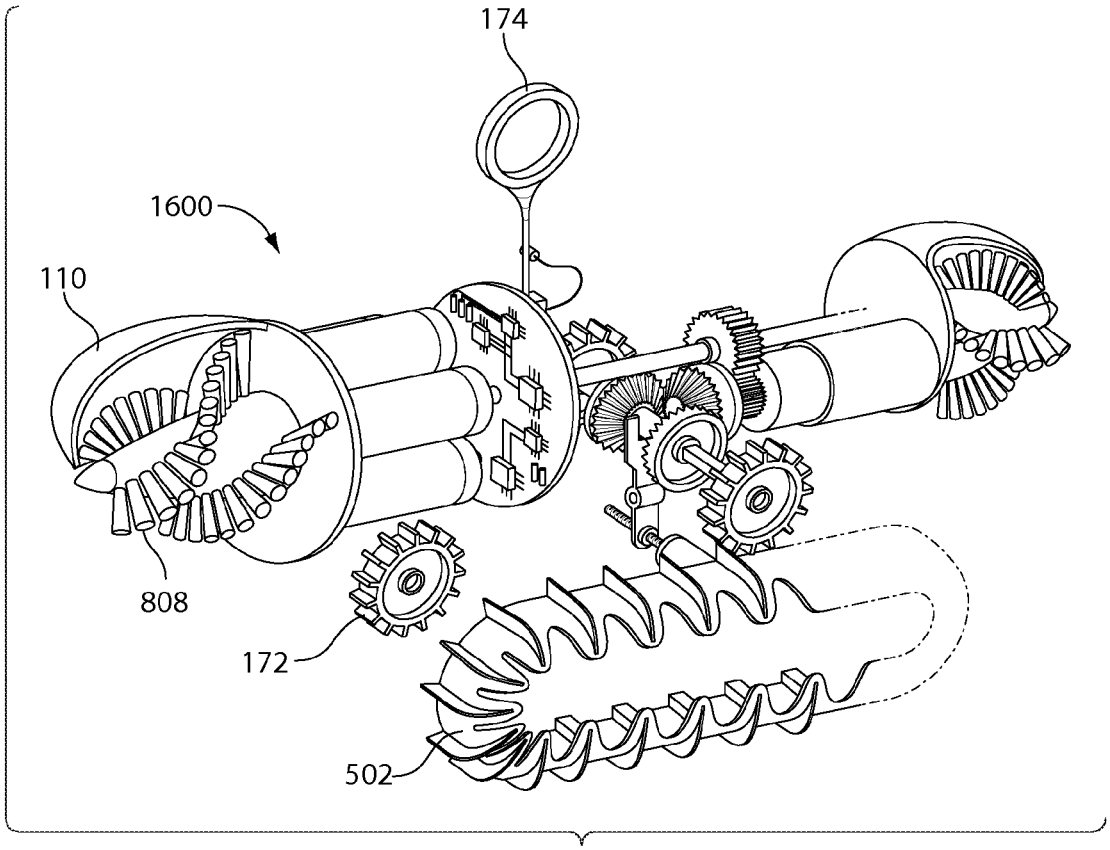
FIG. 16 depicts a cutaway view of a gutter-cleaning device.

Referring to FIG. 16, an exemplary gutter-cleaning device is shown in a cut-away view so that the internal elements are exposed. In this example, the gutter-cleaning device may comprise a spiral stiff bristle brush impeller 808, a chute 110, a placement facility 174, a wheel 172, a tractor tread 502, and the like.

Figure 17:
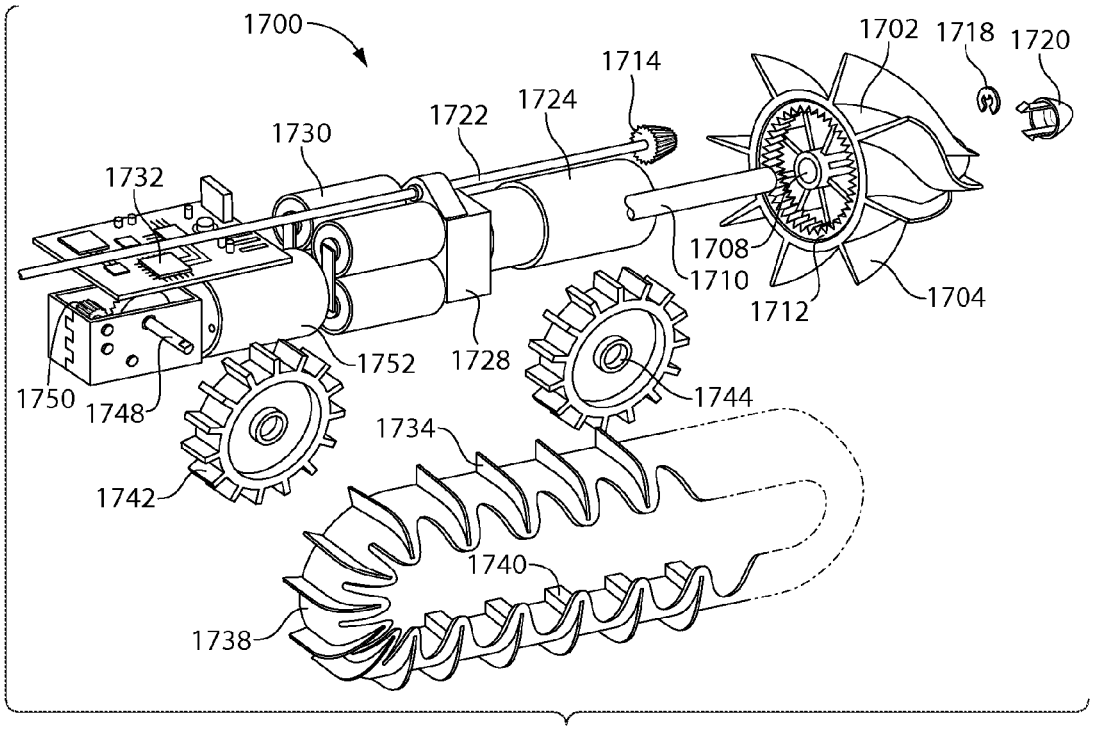
FIG. 17 depicts a cutaway view of a gutter-cleaning device.

Referring to FIG. 17, an exemplary gutter-cleaning device is shown in a cut-away view so that the internal elements are exposed.

Figure 18:
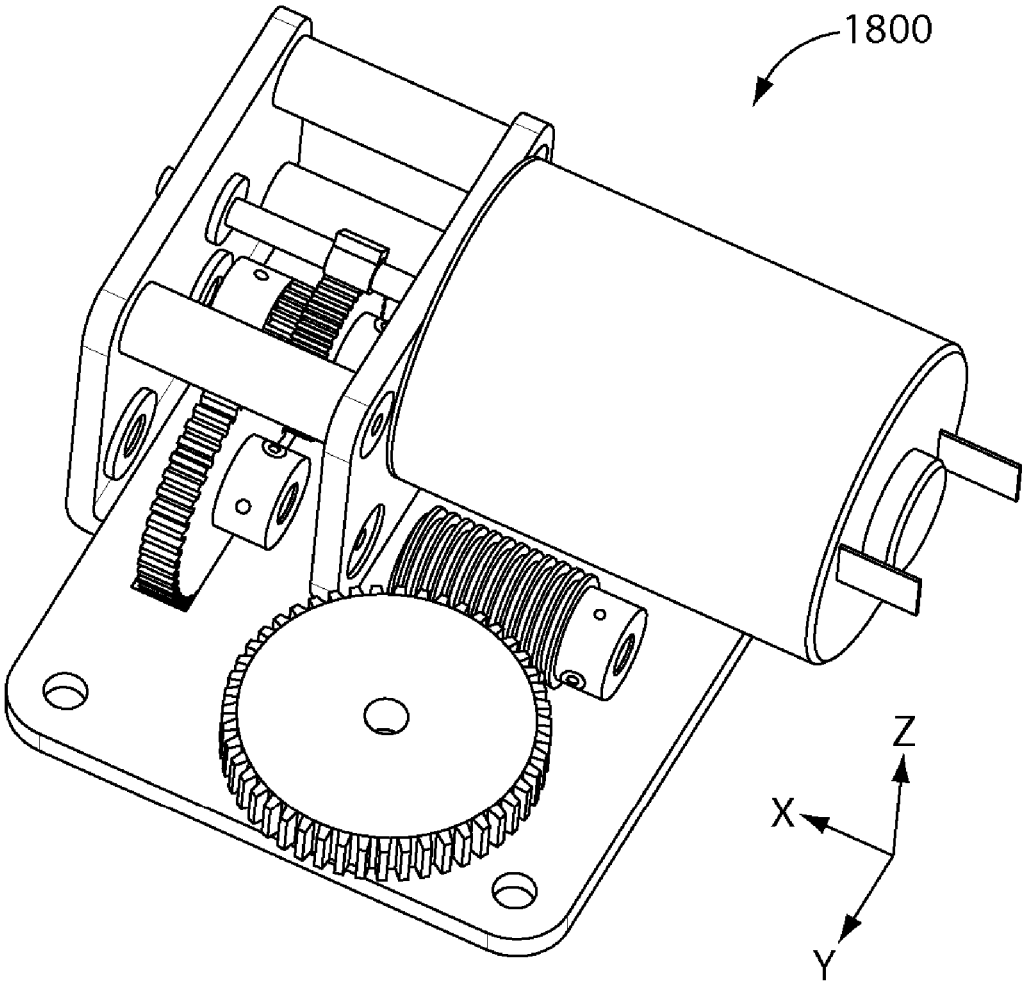
FIG. 18 depicts a transport drive motor.

Referring to FIG. 18, a transport drive motor 154 is depicted.

In an embodiment, the gutter-cleaning device 104 may comprise on-board tools or attachments 120. The on-board tool 120 may be a downspout cleaning tool. When the device 104 reaches a downspout, it may deploy a cleaning tool, such as a weighted brush, into the downspout to clear it of debris. The cleaning tool 102 may run the length of the downspout and may be collected at the base of the downspout. In an embodiment, the tool 120 may be magnetic such that should the tool 120 get stuck in the downspout, it may be removed by dragging it down the spout using a magnetic force from the outside of the downspout. The device 104 may be directed to deploy the tool 120 by a remote control 168, through programming, through detection of the downspout using a vision system 142 or some other detection mechanism, and the like. In embodiments, the downspout cleaning tool may be an impeller 108 that may be oriented vertically to clean at least a top portion of the downspout. The impeller 108 may be present within the housing 152 and may emerge when directed to do so by a remote control 168, through programming, through detection of the downspout using a vision system 142 or some other detection mechanism, and the like. In an alternative embodiment, the impeller may re-orient itself from the usual horizontal position at the end of the device 104 to a vertical position in order to clean the top portion of the downspout.

In an embodiment, the on-board tool 120 may be an air hose attachment. The air hose attachment may attach on one end to an air compressor and on the other end to an impeller 108, an impeller hub 118, the housing 152, the debris tines 112, and the like. Air discharged through the air hose attachment may facilitate loosening and removal of debris.

In an embodiment, the on-board tool 120 may be a water hose attachment. The air hose attachment may attach on one end to a pressurized water supply and on the other end to an impeller 108, an impeller hub 118, the housing 152, the debris tines 112, and the like. Water discharged through the water hose attachment may facilitate loosening and removal of debris.

In an embodiment, the on-board tool 120 may be a weed whacker attachment. The weed whacker attachment my replace an impeller 108 on the gutter-cleaning device 104.

In embodiments, the gutter-cleaning device 104 may be useful for residential gutter cleaning, professional gutter cleaning, as a gardening tool, pipe inspection and clearance, such as oil pipes, plumbing pipes, sewer pipes, water pipes, nuclear power plant pipes, as a dusting tool when the impeller may be formed from electrostatic cloth, and the like.

The elements depicted in flow charts and block diagrams throughout the figures imply logical boundaries between the elements. However, according to software or hardware engineering practices, the depicted elements and the functions thereof may be implemented as parts of a monolithic software structure, as standalone software modules, or as modules that employ external routines, code, services, and so forth, or any combination of these, and all such implementations are within the scope of the present disclosure. Thus, while the foregoing drawings and description set forth functional aspects of the disclosed systems, no particular arrangement of software for implementing these functional aspects should be inferred from these descriptions unless explicitly stated or otherwise clear from the context.

Similarly, it will be appreciated that the various steps identified and described above may be varied, and that the order of steps may be adapted to particular applications of the techniques disclosed herein. All such variations and modifications are intended to fall within the scope of this disclosure. As such, the depiction and/or description of an order for various steps should not be understood to require a particular order of execution for those steps, unless required by a particular application, or explicitly stated or otherwise clear from the context.

The methods or processes described above, and steps thereof, may be realized in hardware, software, or any combination of these suitable for a particular application. The hardware may include a general-purpose computer and/or dedicated computing device. The processes may be realized in one or more microprocessors, microcontrollers, embedded microcontrollers, programmable digital signal processors or other programmable device, along with internal and/or external memory. The processes may also, or instead, be embodied in an application specific integrated circuit, a programmable gate array, programmable array logic, or any other device or combination of devices that may be configured to process electronic signals. It will further be appreciated that one or more of the processes may be realized as computer executable code created using a structured programming language such as C, an object oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software.

Thus, in one aspect, each method described above and combinations thereof may be embodied in computer executable code that, when executing on one or more computing devices, performs the steps thereof. In another aspect, the methods may be embodied in systems that perform the steps thereof, and may be distributed across devices in a number of ways, or all of the functionality may be integrated into a dedicated, standalone device or other hardware. In another aspect, means for performing the steps associated with the processes described above may include any of the hardware and/or software described above. All such permutations and combinations are intended to fall within the scope of the present disclosure.

While the invention has been disclosed in connection with the preferred embodiments shown and described in detail, various modifications and improvements thereon will become readily apparent to those skilled in the art. Accordingly, the spirit and scope of the present invention is not to be limited by the foregoing examples, but is to be understood in the broadest sense allowable by law.

All documents referenced herein are hereby incorporated by reference.

What is claimed is:

1. A gutter-cleaning device, comprising:

a housing containing an impeller drive facility including a motor rotationally operable at more than 400 rpm, the housing having a height of not more than 2.75 inches and the housing configured to fit into an open residential gutter;

an impeller having an axis disposed at an end of the housing and connected to an output of the impeller drive facility, the impeller having a plurality of impeller vanes coupled to the axis including at least one flexible paddle and at least one stiff bristle brush, each one of the plurality of impeller vanes sufficiently flexible to facilitate deflection under a cross brace of the open residential gutter, wherein the axis is oriented parallel to a direction of travel of the device when placed for use in the open residential gutter;

a transport drive including tractor/tread wheels and tracks adapted to transport the device along an interior surface of the open residential gutter;

a wireless communication facility mounted within the housing and operable to receive control signals from a remote control for controlling at least one of the transport drive and the impeller drive facility;

an antenna electrically connected to the wireless communication facility and disposed flush against the housing;

at least one nickel cadmium battery within the housing to provide power to at least one of the impeller drive facility, the transport drive, and the wireless communication facility; and a placement facility with a removable and replaceable attachment point to assist a user in placement of the gutter-cleaning device in the open residential gutter.

2. The device of claim 1, wherein the placement facility facilitates placement of the gutter-cleaning device into the gutter.

3. The device of claim 1, wherein the impeller is formed from at least one of a molded elastomer, neoprene, rubber, plastic, and an electrostatic cloth.

4. The device of claim 1, wherein the impeller further includes at least one of a helical bristled brush, a full stiff bristle brush, a spiral stiff bristle brush, a wire brush, a dethatching brush, an alternating paddle brush, a flexible bucket, a multiply vaned impeller, and an alternating flexible blade.

5. The device of claim 1, wherein the transport drive drives at least one of a wheel, a snake drive, a worm drive, a crab or walking drive, a scoot-and-compress or accordion drive, and a string of beads drive.

6. The device of claim 1, further comprising a vision system disposed on the housing for facilitating navigation and programming of the device.

7. The device of claim 1, further comprising a navigation system to facilitate autonomous control of the device.

8. The device of claim 7, further comprising a programming facility to set programs for autonomous control of the device.

9. The device of claim 1, further comprising a remote control facility for communicating with the wireless communication facility to remotely control at least one of the transport drive and the impeller drive facility.

10. The device of claim 9, wherein an antenna of the remote control facility is associated with a placement facility.

11. The device of claim 1, wherein the housing has a height less than one or more gutter cross braces of the open residential gutter.

12. The device of claim 11 further comprising an impeller chute to direct debris from the impeller, the impeller chute configured to be lower in height than the gutter cross braces.

* * * * *